US010862217B2

(12) United States Patent
Kasahara

(10) Patent No.: US 10,862,217 B2
(45) Date of Patent: Dec. 8, 2020

(54) COMMUNICATION APPARATUS

(71) Applicant: NEC Corporation, Tokyo (JP)

(72) Inventor: Yoshiaki Kasahara, Tokyo (JP)

(73) Assignee: NEC CORPORATION, Tokyo (JP)

( * ) Notice: Subject to any disclaimer, the term of this patent is extended or adjusted under 35 U.S.C. 154(b) by 41 days.

(21) Appl. No.: 16/346,583

(22) PCT Filed: Aug. 22, 2017

(86) PCT No.: PCT/JP2017/029942

§ 371 (c)(1),
(2) Date: May 1, 2019

(87) PCT Pub. No.: WO2018/087982

PCT Pub. Date: May 17, 2018

(65) Prior Publication Data

US 2019/0260135 A1 Aug. 22, 2019

(30) Foreign Application Priority Data

Nov. 9, 2016 (JP) ..... 2016-219178

(51) Int. Cl.
*H01Q 19/06* (2006.01)
*H01Q 13/02* (2006.01)
(Continued)

(52) U.S. Cl.
CPC ..... *H01Q 19/06* (2013.01); *H01P 7/082* (2013.01); *H01Q 13/02* (2013.01); *H01Q 13/10* (2013.01); *H01Q 15/02* (2013.01); *H01Q 15/08* (2013.01)

(58) Field of Classification Search
CPC ..... H01Q 19/06; H01Q 15/08; H01Q 15/00; H01Q 15/02; H01Q 13/10; H01Q 13/02;
(Continued)

(56) References Cited

U.S. PATENT DOCUMENTS 5,677,796 A 10/1997 Zimmerman et al.
6,864,840 B2 * 3/2005 Zhu ..... H01P 1/181 343/700 MS
(Continued)

FOREIGN PATENT DOCUMENTS

CN 103296476 A 9/2013
CN 103594789 A 2/2014
(Continued)

OTHER PUBLICATIONS

Ding et al., "Metasurface for polarization and phase manipulating of the electromagnetic wave simultaneously", 2016 International Conference on Electromagnetics in Advanced Applications (ICEAA), IEEE, Sep. 19, 2016, pp. 393-394 (total 3 pages).
(Continued)

*Primary Examiner* — Jimmy T Vu

(57) ABSTRACT

According to the present invention, provided is a communication apparatus including a radiation source (10) that radiates an electromagnetic wave, and a first phase control plate (11) that is disposed at a position of a distance $L_1$ in a radio wave radiation direction from the radiation source (10). In the first phase control plate (11), a phase of a transmitted electromagnetic wave differs according to a distance from a representative point on the first phase control plate (11). The radiation source (10) is able to supply power up to a position separated from the representative point on the first phase control plate (11) by $L_1/2$.

16 Claims, 37 Drawing Sheets

(51) Int. Cl.

| | |
|---|---|
| ***H01P 7/08*** | (2006.01) |
| ***H01Q 13/10*** | (2006.01) |
| ***H01Q 15/08*** | (2006.01) |
| ***H01Q 15/02*** | (2006.01) |

(58) Field of Classification Search
CPC ..... H01Q 21/08; H01Q 21/18; H01Q 21/20; H01P 7/082
See application file for complete search history.

(56) References Cited

U.S. PATENT DOCUMENTS

| | | | |
|---|---|---|---|
| 2008/0165079 | A1 | 7/2008 | Smith et al. |
| 2008/0238810 | A1 | 10/2008 | Winsor |

FOREIGN PATENT DOCUMENTS

| | | | |
|---|---|---|---|
| JP | 58-219802 | A | 12/1983 |
| JP | 2005-37139 | A | 2/2005 |
| JP | 2006-166399 | A | 6/2006 |
| JP | 4079171 | B2 | 4/2008 |
| JP | 2011-254482 | A | 12/2011 |
| JP | 2012-175422 | A | 9/2012 |
| WO | 2005/034291 | A1 | 4/2005 |
| WO | 2016/148274 | A1 | 9/2016 |

OTHER PUBLICATIONS

Mangi et al., "Manipulating Electromagnetic Wave Linear-to-Circular Polarization Conversion Transmitter Based on Periodic Strips Array", 2016 3rd International on Information Science and Control Engineering, IEEE, Jul. 8, 2016, pp. 1342-1345 (total 5 pages).

International Search Report for PTC/JP2017/029942 dated Nov. 14, 2017.

* cited by examiner

COMMUNICATION APPARATUS

This application is a National Stage Entry of PCT/JP2017/029942 filed on Aug. 22, 2017, which claims priority from Japanese Patent Application 2016-219178 filed on Nov. 9, 2016, the contents of all of which are incorporated herein by reference, in their entirety.

TECHNICAL FIELD

The present invention relates to a communication apparatus.

BACKGROUND ART

There has been proposed a communication apparatus (for example, a millimeter-wave antenna) which realizes high directivity through a combination of a radio wave radiation source (for example, a horn antenna) and a lens (for example, a dielectric lens). In the communication apparatus, it is necessary to increase an effective aperture area of the lens in order to realize the high directivity. Typically, in the configuration using the radio wave radiation source and the dielectric lens, a horn antenna is used as the radio wave radiation source. In the horn antenna, it is necessary to increase a distance between a radio wave radiation source and a lens in order to increase an effective aperture area. The dielectric lens itself has a certain amount of thickness. As a result, the whole thickness is increased, and thus there is a problem in which a communication apparatus is large-sized.

As a technique of solving the problem, Patent Document 1 discloses an antenna apparatus having a dielectric lens. The dielectric lens is formed of a rotationally symmetric body having an optical axis as a rotation center, and has plural front-surface-side refractive surfaces in a concentric circle shape in which a front surface which is the surface on the opposite side to a primary radiator side protrudes in the front surface direction, and step difference surfaces connecting adjacent front-surface-side refractive surfaces to each other. The step difference surfaces form an angle within a range of ±20 degrees with respect to a main light beam which is incident to any position in a rear surface facing the primary radiator from a focal point and advances through the lens, and plural curved surfaces in a concentric circle shape are provided by zoning at a position of the main light beam passing through a front-surface-side refractive surface in the rear surface. By using such a shape, zoning is possible without changing an effective aperture surface distribution, and thus thinning of a lens portion is realized.

RELATED DOCUMENT

Patent Document

[Patent Document 1] Japanese Patent No. 4079171

SUMMARY OF THE INVENTION

Technical Problem

However, according to the technique disclosed in Patent Document 1, the lens portion can be thinned, but a distance between the radio wave radiation source and the lens cannot be reduced. The lens processing accuracy is increased, and this causes a problem such as a cost increase.

An object of the present invention is to realize miniaturization of a communication apparatus.

Solution to Problem

According to the present invention, there is provided a communication apparatus including a radiation source that radiates an electromagnetic wave; and a first phase control plate that is disposed at a position of a distance $L_1$ in a radio wave radiation direction from the radiation source, in which, in the first phase control plate, a phase of a transmitted electromagnetic wave differs according to a distance from a representative point on the first phase control plate, and, in which the radiation source is able to supply power up to a position separated from the representative point on the first phase control plate by $L_1/2$.

Advantageous Effects of Invention

According to the present invention, it is possible to realize thinning of a communication apparatus.

BRIEF DESCRIPTION OF THE DRAWINGS

The above-described object, and other objects, features, and advantages will become apparent throughout preferable example embodiments described below and the accompanying drawings.

DESCRIPTION OF EMBODIMENTS

First Example Embodiment

Figure 1:
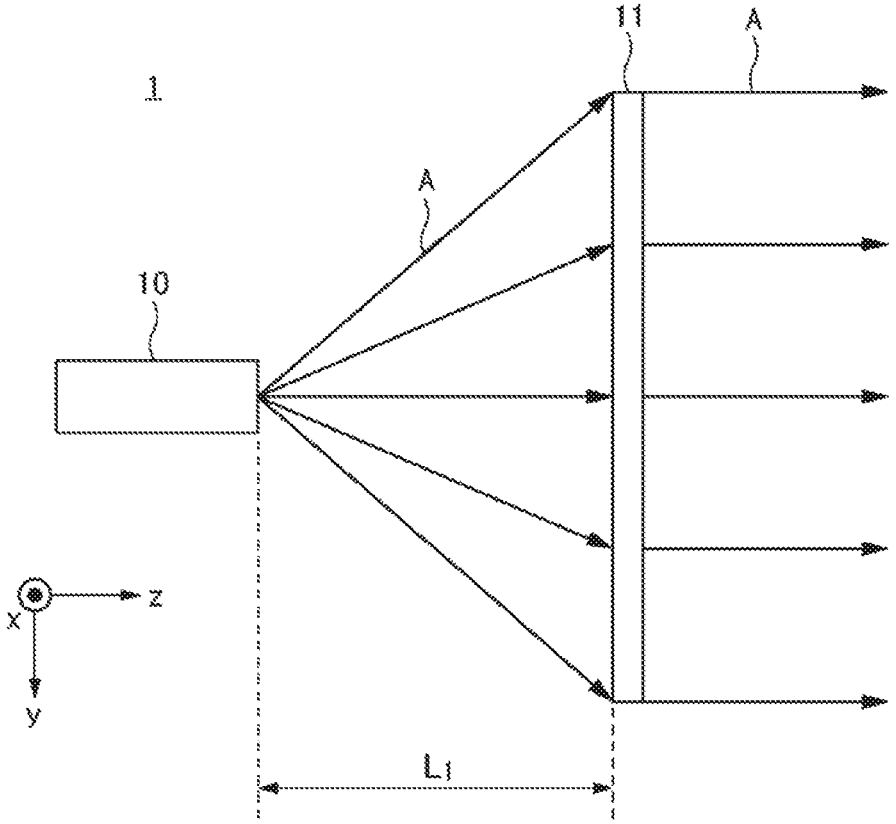
FIG. 1 is an example of the overall schematic diagram of a communication apparatus of the present example embodiment.

FIG. 1 is a schematic diagram illustrating a communication apparatus 1 of the present example embodiment. The communication apparatus 1 is, for example, an antenna apparatus (for example, a millimeter-wave antenna). As illustrated, the communication apparatus 1 includes a radio wave radiation source 10 and a first phase control plate 11. In the figure, an arrow A indicates an advancing direction of an electromagnetic wave. Phases of electromagnetic waves radiated from the radio wave radiation source 10 are aligned with each other by the first phase control plate 11.

The first phase control plate 11 is located at a distance $L_1$ from the radio wave radiation source 10 in a direction (radio wave radiation direction) in which the radio wave radiation source radiates an electromagnetic wave. The radio wave radiation direction is, in electromagnetic waves radiated with a spread in a width direction toward the first phase control plate 11 from the radio wave radiation source 10, a direction of a central axis passing through the substantial center of the spread in the width direction of the electromagnetic waves. The first phase control plate 11 may extend in a direction substantially perpendicular to the direction in which the radio wave radiation source 10 radiates an electromagnetic wave, and may extend to be tilted at a predetermined angle from the direction substantially perpendicular to the direction. The first phase control plate 11 has a diameter of $L_1/2$ or more, and more preferably $L_1$ or more with respect to the distance $L_1$ to the radio wave radiation source 10. The first phase control plate 11 extends in an xy plane in the figure, and has a z direction in the figure as a thickness direction. A distance between the radio wave radiation source 10 and the first phase control plate 11 may be shorter than the diameter of the first phase control plate 11. In other diagrams described below, the x direction, the y direction, and the z direction are illustrated as appropriate.

Figure 2A:
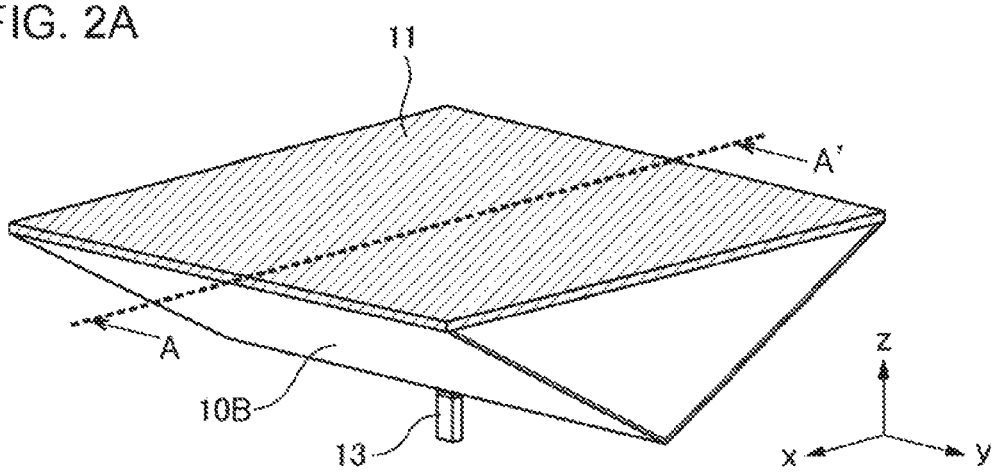
FIG. 2A is an example of the overall schematic diagram of the communication apparatus of the present example embodiment.
Figure 2B:
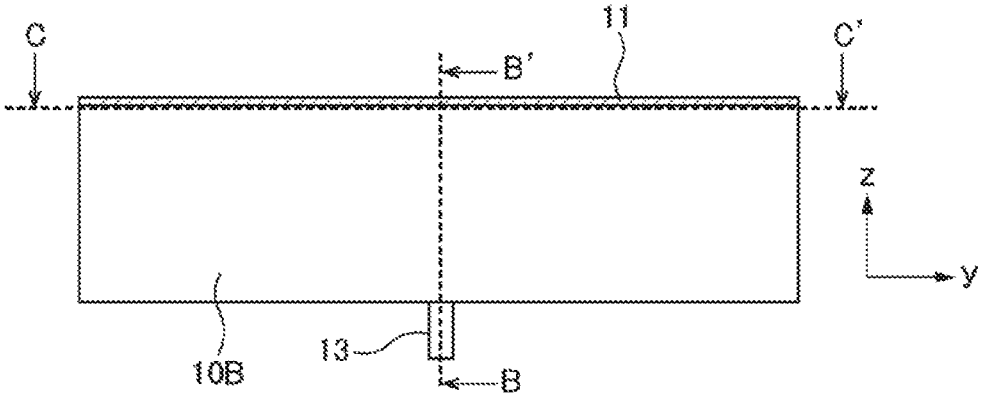
FIG. 2B is an example of the overall schematic diagram of the communication apparatus of the present example embodiment.
Figure 2C:
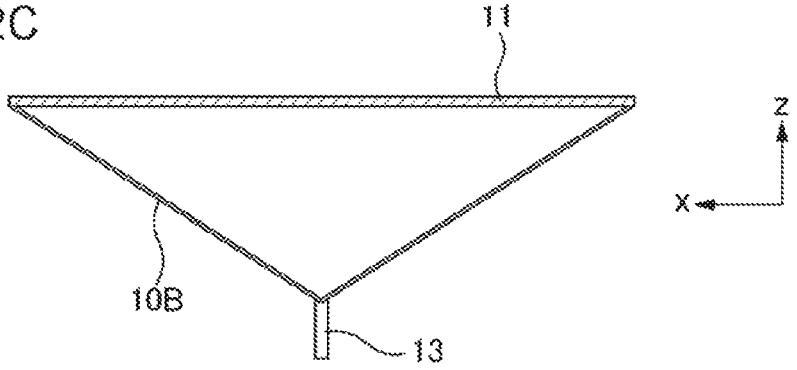
FIG. 2C is an example of the overall schematic diagram of the communication apparatus of the present example embodiment.

The radio wave radiation source 10 has the low directivity feature of being able to supply power up to a position separated from a representative point (definition of the representative point will be described later) on the first phase control plate 11 by $L_1/2$. Here, the phrase "being able to supply power" indicates that, for example, 1/10 or more of power is able to be supplied in a maximum gain direction of the radio wave radiation source 10. FIGS. 2A-2C illustrate a preferable example of implementing the radio wave radiation source 10. In a case where a high-directivity antenna is used as the radio wave radiation source 10, power reaches only a central portion of the first phase control plate 11, and an effective aperture area is reduced such that a high-directivity beam cannot be formed.

Figure 3:
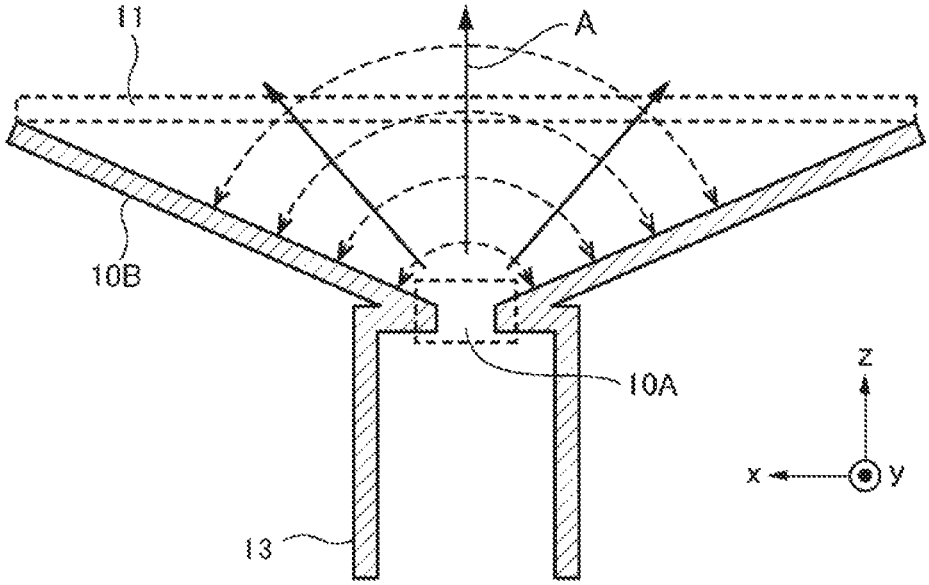
FIG. 3 is an example of a sectional schematic diagram of the communication apparatus of the present example embodiment.
Figure 4:
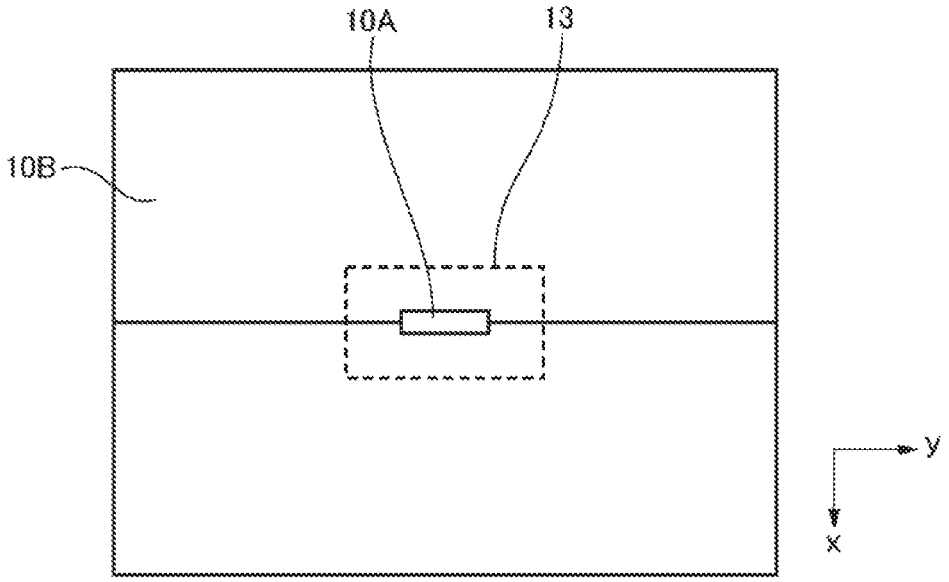
FIG. 4 is an example of a sectional schematic diagram of the communication apparatus of the present example embodiment.

FIG. 2A is an example of a perspective view of the communication apparatus 1 of the present example embodiment. FIG. 2B is a view in which the communication apparatus 1 in FIG. 2A is observed in the x direction in the figure. FIG. 2C is a view in which the communication apparatus 1 in FIG. 2A is observed in the y direction in the figure. FIG. 3 is a sectional view taken along the line A-A' in FIG. 2A and the line B-B' in FIG. 2B. FIG. 4 is a sectional view taken along the line C-C' in FIG. 2B.

As illustrated in FIGS. 2 and 4, the radio wave radiation source 10 of the communication apparatus 1 of the present example embodiment is configured with a slot opening 10A which is provided on a conductor and having a rectangular shape which is open in the disposition direction of the first phase control plate 11, and a conductive plate 10B connecting a long side (refer to FIG. 4) of the slot opening 10A to the first phase control plate 11. The conductive plate 10B is in a tilted surface state with respect to the x direction (leans from the x direction). The conductive plate 10B gradually spreads from the slot opening 10A toward the first phase control plate 11. As illustrated in FIGS. 2B and 2C, the x direction is blocked by the conductive plate 10B, but the y direction is not blocked. Power is supplied to the slot opening 10A from a power supply portion 13, and thus the slot opening 10A and the conductive plate 10B operate as the radio wave radiation source 10.

Figure 34:
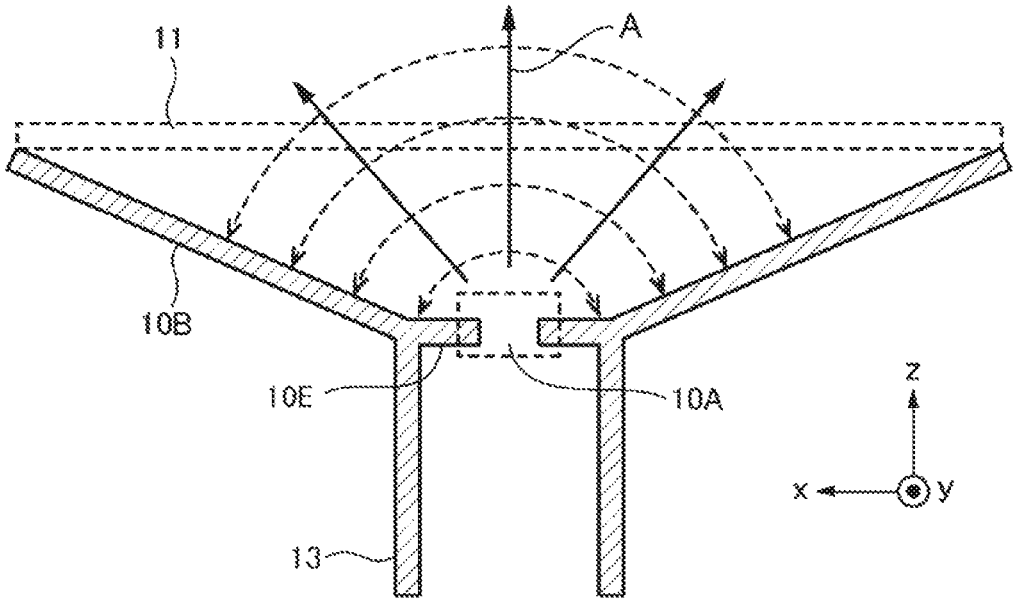
FIG. 34 is an example of a sectional schematic diagram of the communication apparatus of the present example embodiment.
Figure 35:
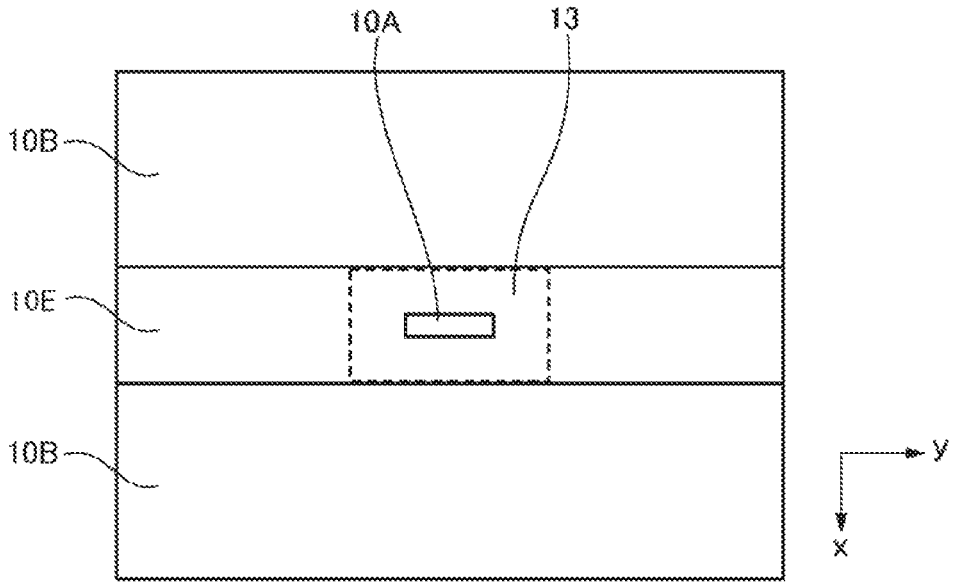
FIG. 35 is an example of a sectional schematic diagram of the communication apparatus of the present example embodiment.

FIGS. 2 to 4 illustrate an example in which the long side of the slot opening 10A and the conductive plate 10B are directly connected to each other, but the slot opening 10A and the conductive plate 10B may not be directly connected to each other as illustrated in FIGS. 34 and 35. In the example illustrated in FIGS. 34 and 35, the slot opening 10A is connected to the conductive plate 10B through another conductive plate 10E. FIGS. 2 to 4, 34, 35 illustrate a case where the conductive plate 10B is a flat plate, but the conductive plate 10B is not necessarily required to be a flat plate, and may have a curvature.

Figure 36:
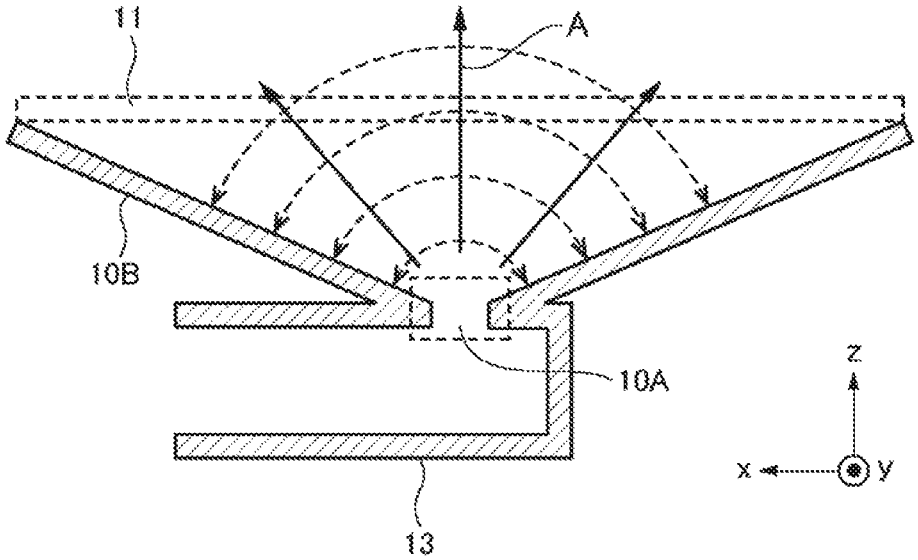
FIG. 36 is an example of a sectional schematic diagram of the communication apparatus of the present example embodiment.
Figure 37:
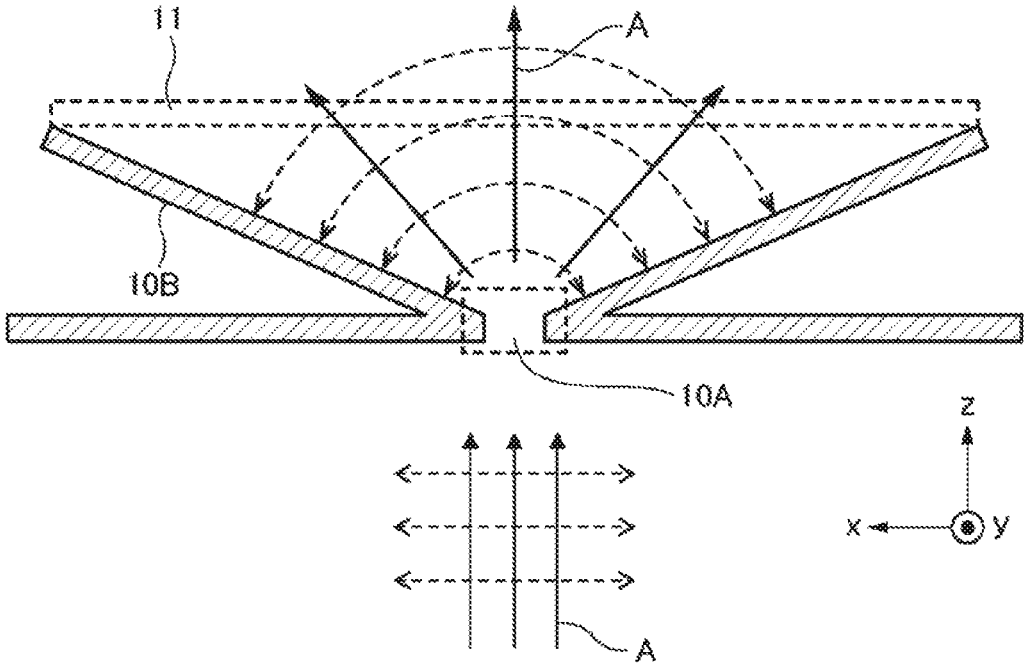
FIG. 37 is an example of a sectional schematic diagram of the communication apparatus of the present example embodiment.

FIGS. 2 to 4, 34, 35 illustrate a case where power is supplied through a wave guide tube from the z axis negative direction in the figure, but a power supply method is not limited to such a method. Any method may be used as long as the slot opening 10A is efficiently excited. For example, as illustrated in FIG. 36, power may be supplied through a wave guide tube extending from the x axis positive direction. A configuration as illustrated in FIG. 37 may be prepared, and power may be supplied by radiating an electromagnetic wave from the z axis negative direction. Power may be supplied through a micro-strip line disposed across the slot opening 10A. Other various excitation methods for the slot opening 10A may be used.

The radio wave radiation source 10 illustrated in FIGS. 2 to 4 has the above-described low directivity feature due to the conductive plate 10B, and realizes the effect of the present invention. A general slot antenna (refer to FIGS. 5 and 6; FIG. 6 is a sectional view taken along the line q-q' in FIG. 5) in which an opening is provided in the planar conductive plate 10B has non-directivity in the xz plane, and has a doughnut type directivity without a radiation intensity in the y axis direction in the xy plane, due to a direction of an electric field vector induced by the slot opening, and the request for a boundary condition of the planar conductive plate 10B. A solid arrow A in FIG. 6 represents an advancing direction of a radio wave, and a dotted arrow represents a direction of an electric field. In such a directivity, as illustrated in FIG. 6, in a case where the first phase control plate 11 is provided over (z axis positive direction) the conductive plate 10B, power scatters in the x axis direction and the −x axis direction, and thus a total amount of power contributing to formation of a high-directivity beam is reduced. In the communication apparatus 1 illustrated in FIGS. 2, 3, and 4, the conductive plate 10B is in a tilted surface state with respect to the x direction, and thus it is possible to realize a directivity in which almost overall power can be introduced into the first phase control plate 11 by avoiding scattering of power in the x axis direction and the −x axis direction without changing an aspect of an electric field vector. A solid arrow A in FIG. 3 represents an advancing direction of a radio wave, and a dotted arrow represents a direction of an electric field vector.

A radio wave reaching a point on the first phase control plate 11 closest to a radio wave radiation portion (the slot opening 10A in the present example embodiment) of the radio wave radiation source 10 reaches the first phase control plate 11 at the shortest optical path length. The point on the first phase control plate 11 closest to the radio wave radiation portion is set as the representative point, and the first phase control plate 11 is formed to give different phase delays according to distances from the representative point on the phase control plate 11. The representative point is preferably located near the center of a front surface of the first phase control plate 11.

The first phase control plate 11 may be configured, for example, by arranging unit structures giving different phase delays according to distances from the representative point on the phase control plate 11. The "representative point" is a point on the front surface (a surface facing the radio wave radiation source 10) of the phase control plate 11. The "distance from the representative point" is a distance from the representative point on the front surface. Specifically, the first phase control plate 11 is configured by arranging unit structures giving a smaller phase delay amount toward an edge of the phase control plate from the representative point. The description is made supposing that a phase range is not limited to a range of 360 degrees. The phase delay amount indicates a phase difference between an incidence surface (a surface facing the radio wave radiation source 10) and an emission surface (a surface opposite to the surface facing the radio wave radiation source 10) of the first phase control plate 11. The function is realized by arranging plural types of unit structures having different performances in a predetermined order. Hereinafter, a description thereof will be made.

When in electromagnetic waves which are radiated with a spread in a width direction toward the first phase control plate 11 from the radio wave radiation source 10, a line passing through the center of the spread in the width direction of the electromagnetic waves is referred to as a central axis, an angle formed between the central axis and the phase control plate is larger than 0 degrees, and is smaller than 180 degrees.

In the first phase control plate 11 realizing the function, a unit structure group giving an identical phase delay to transmitted electromagnetic waves surrounds the periphery of the representative point. Each of plural types of unit structure groups giving different phase delay amounts to transmitted electromagnetic waves surrounds the periphery of the representative point. Note that the "identical amount"

is a concept including not only completely matching but also an amount including an error (a variation in a phase delay amount due to a processing error, an etching error, or the like). A difference in a phase amount deviated between unit structures of a unit structure group deviating phases of transmitted electromagnetic waves by an identical amount is, for example, 45 degrees or less, and is more preferably 30 degrees or 15 degrees or less.

In a case where an angle formed between the central axis and the front surface of the first phase control plate 11 is 90 degrees, a unit structure group giving an identical phase delay to transmitted electromagnetic waves is circularly disposed centering on the representative point. Plural types of unit structure groups giving different phase delays to transmitted electromagnetic waves are concentrically arranged centering on the representative point.

Figure 22:
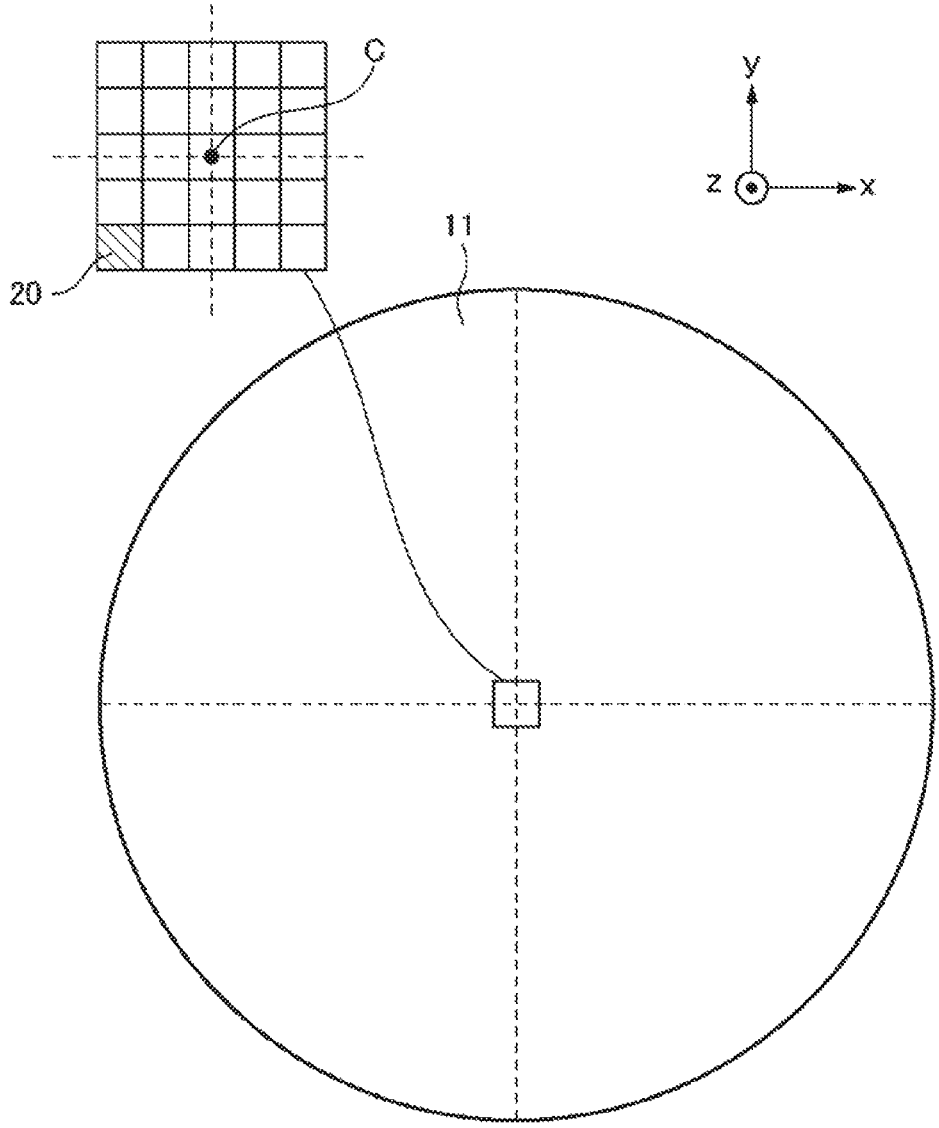
FIG. 22 is a diagram for explaining an example of a method of arranging unit structures.
Figure 23:
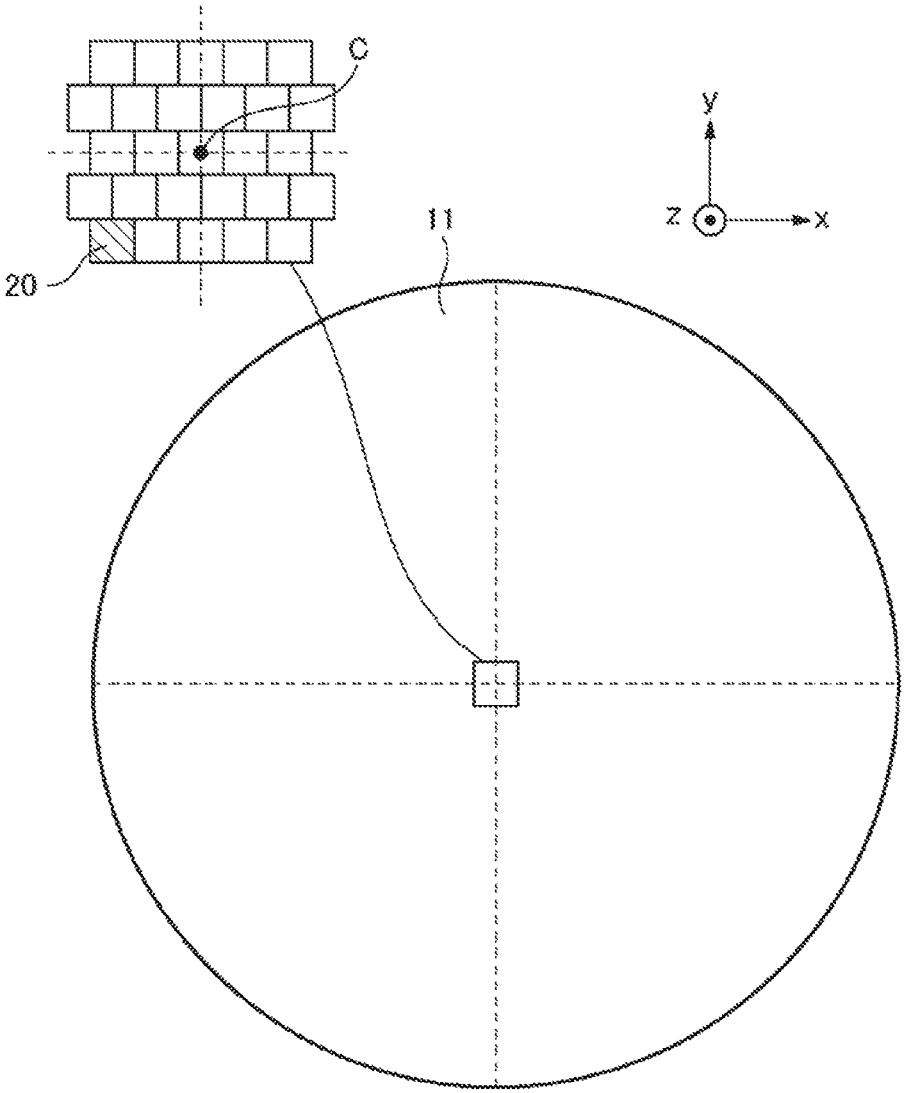
FIG. 23 is a diagram for explaining an example of a method of arranging unit structures.
Figure 25:
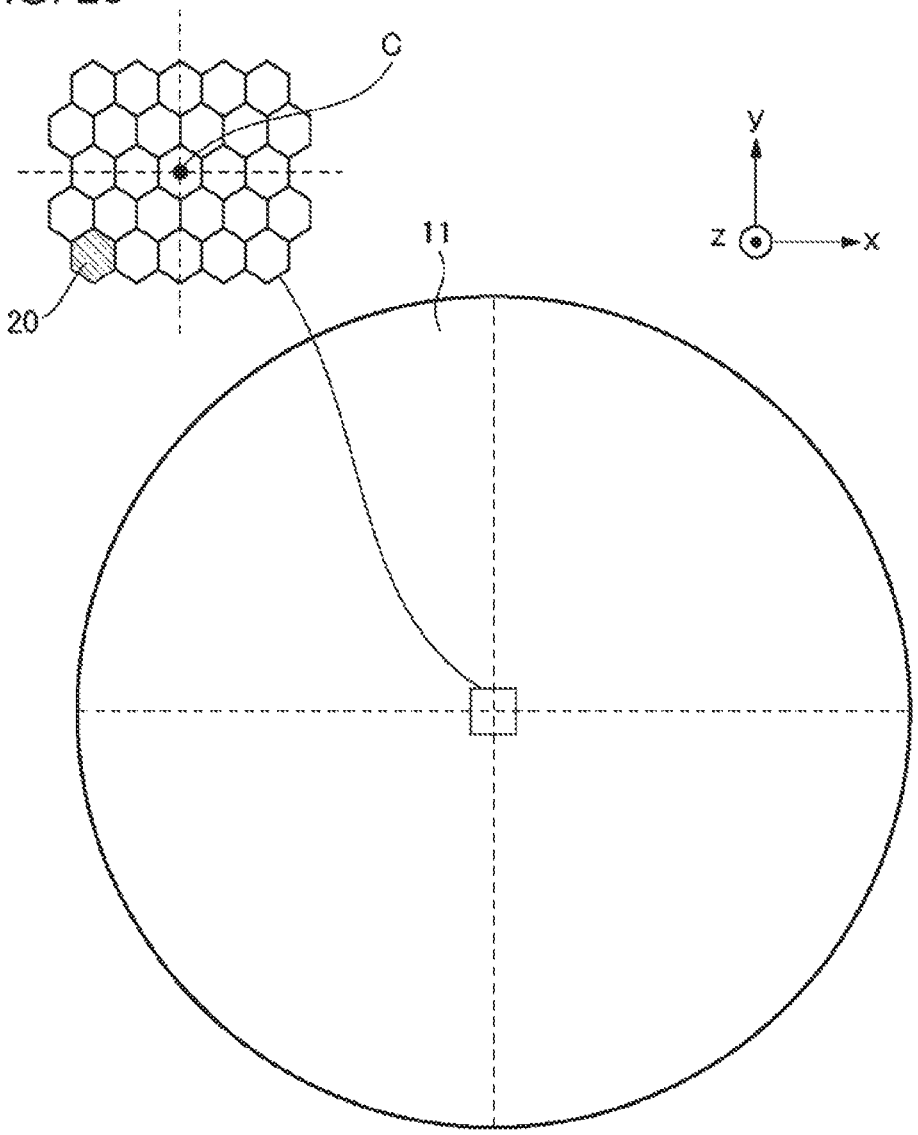
FIG. 25 is a diagram for explaining an example of a method of arranging unit structures.

For example, as illustrated in FIGS. 22, 23, and 25, a reference point (for example, the center of a unit structure 20) is defined for each of plural arranged unit structures 20, and a distance N between the reference point and a representative point C of the first phase control plate 11 is computed with respect to each unit structure 20. Plural unit structures are grouped according to a value of N. For example, the unit structures 20 satisfying each of plural numerical value conditions such as $n0 \leq N \leq n1$, $n1 \leq N \leq n2$, $n2 \leq N \leq n3$, . . . may be included in an identical group. Configurations and characteristics of plural unit structures 20 in an identical group are assumed to be same as each other. Consequently, the circular and concentric arrangements can be realized.

Note that characteristics of unit structures of each group may be determined such that phase delay amounts of radio waves transmitted through the first phase control plate 11 are reduced with respect to phases of radio waves incident to the first phase control plate 11 according to an increase of a value of N such as $n0 \leq N \leq n1$, $n1 \leq N \leq n2$, $n2 \leq N \leq n3$, . . . . In this case, a phase delay amount starts from a first reference value, and the phase delay amount is reduced by a predetermined amount according to an increase of a value of N.

The first phase control plate 11 includes, for example, a metal pattern layer which is a meta-surface (an artificial sheet-like material formed by using the concept of metamaterial) and is formed of one or plural layers. In a case where the first phase control plate 11 is formed of plural layers, each of the plurality of layers has a metal pattern. Note that, for example, a dielectric is present in a portion other than the metal pattern.

The metal pattern of the metal pattern layer has a structure in which plural types of unit structures configured to include metals are arranged in a two-dimensional manner with a predetermined rule or at random. A size of the unit structure is sufficiently smaller than a wavelength of an electromagnetic wave. Thus, a set of unit structures functions as an electromagnetic continuous medium. Permeability and a dielectric constant are control by using a structure of a metal pattern, and thus a refractive index (phase velocity) and impedance can be controlled separately.

Here, details of the first phase control plate 11 will be described. Note that a description made below is only an example, and there is no limitation thereto.

Figure 12:
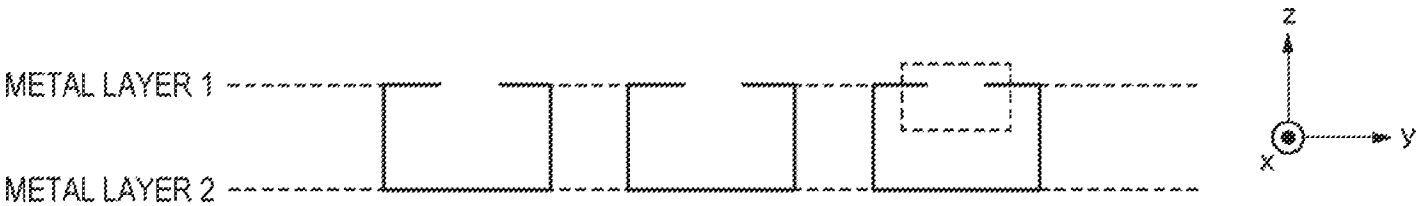
FIG. 12 is a diagram for explaining an example of a structure for controlling permeability.

First, with reference to FIG. 12, a description will be made of an example of a metal pattern layer for controlling permeability among metal pattern layers configuring the first phase control plate 11. FIG. 12 is a diagram illustrating a structure of a so-called split ring resonator. A metal pattern layer for controlling permeability is formed of two metal pattern layers. The metal pattern layer extends in the xy plane in the figure. A z direction in the figure is a laminate direction of the two layers. A linear or tabular metal is formed in a lower layer. Two linear or tabular metals separated from each other are formed in an upper layer. Each of the upper two metals is connected to an identical metal of the lower layer through, for example, a via. As illustrated, the lower one metal, the upper two metals, and two vias are connected to each other so as to form an annular metal (split ring) of which a part is open when viewed from the x direction. FIG. 12 illustrates a scene in which such split ring structures are arranged in the y direction. The split ring structures may be arranged in the x direction.

In the structure, in a case where a magnetic field Bin having a component in the x direction is applied, an annular current Jind flows along the split ring. The split ring is described by using a series LC resonator circuit model. An inductance L forming a series LC resonator may be adjusted by adjusting a length in a circumferential direction of the annular metal. A capacitance C may be adjusted by adjusting a width of the opening portion (a portion surrounded by a dashed line in FIG. 12) of the annular metal, a line width of the metal, or the like. The current Jind may be adjusted by adjusting L and C. A magnetic field generated by the current Jind may be adjusted by adjusting the current. In other words, the permeability can be controlled.

Figure 9:
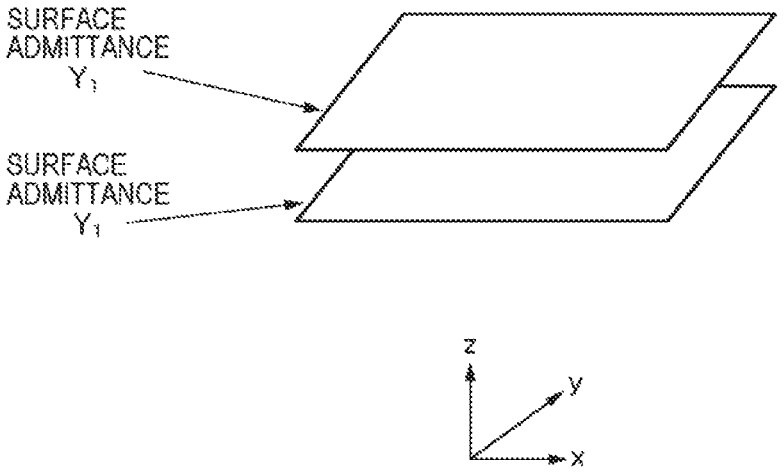
FIG. 9 is a diagram for explaining an example of a structure for controlling permeability.

With reference to FIG. 9, a description will be made of another example of a structure of a metal pattern layer for controlling the permeability among metal pattern layers configuring the first phase control plate 11. The metal pattern layer for controlling the permeability is configured by disposing two metal pattern layers to face each other in different layers. Two metal pattern layers extend in planes parallel to the xy plane in the figure. Each metal pattern layer has a metal pattern for controlling impedance (admittance). When a magnetic field Bin having a component parallel to the two tabular metals is applied between the two tabular metals, currents Jind flow in directions opposite to each other in the two metal pattern layers. The currents induced by the magnetic field Bin necessarily flow in opposite directions, and can thus induce a magnetic field. In other words, the currents may be regarded as annular currents. The current Jind may be adjusted by adjusting admittance values of the two metal pattern layers. A magnetic field generated by the current Jind may be adjusted by adjusting the current. In other words, the permeability can be controlled. Adjustment of the admittance of the metal pattern layer may be realized by adjusting the inductance L or the capacitance C formed by the metal pattern of the metal pattern layer.

Figure 7:
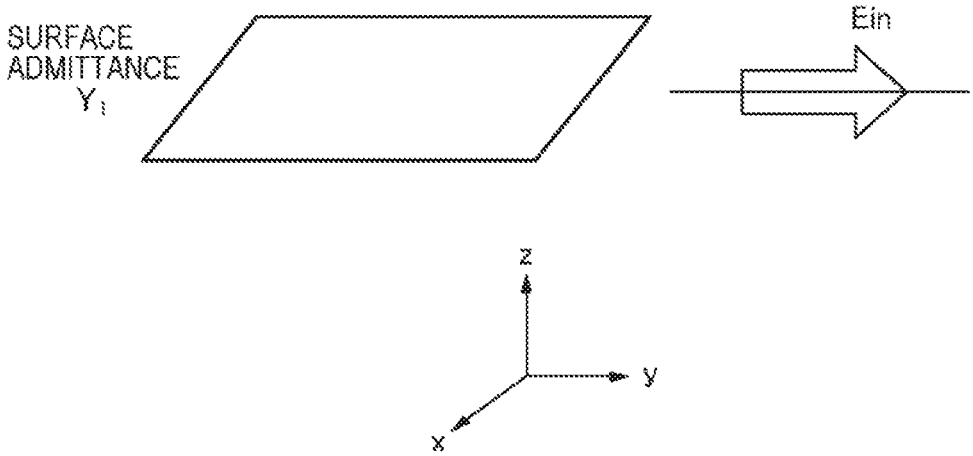
FIG. 7 is a diagram for explaining an example of a structure for controlling a dielectric constant.

Next, with reference to FIG. 7, a description will be made of an example of a structure of a metal pattern layer for controlling a dielectric constant among metal pattern layers configuring the first phase control plate 11. A metal pattern layer for controlling a dielectric constant is formed of a single metal pattern layer. A metal pattern layer extends in the xy plane in the figure. The metal pattern layer has a metal pattern for controlling impedance (admittance). A potential difference is induced between two points on an admittance adjustment surface of the metal pattern layer by an electric field Ein in a direction as illustrated in FIG. 7. The current Jind which flows due to the potential difference may be adjusted by adjusting an admittance value of the metal pattern layer, and thus an electric field generated thereby may be adjusted. In other words, a dielectric constant can be controlled.

It can be seen from the above description that permeability is controlled by using two metal pattern layers, and a dielectric constant is controlled by using a single metal pattern layer. Impedance and a phase constant are given by Equations (1) and (2) as follows by using the dielectric constant and the permeability. As mentioned above, the dielectric constant and the permeability are controlled such that a vacuum impedance value and an impedance value of the phase control plate can be matched with each other (that is, a non-reflection condition can be maintained), and the phase constant is controlled, and thereby a delayed phase shift amount in the phase control plate can be controlled.

$$\eta eff = \sqrt{\frac{\mu eff}{\varepsilon eff}} \tag{1}$$

$$keff = \omega\sqrt{\varepsilon eff\,\mu eff} \tag{2}$$

Here, a description will be made of an example of a metal pattern for controlling admittance.

Figure 11:
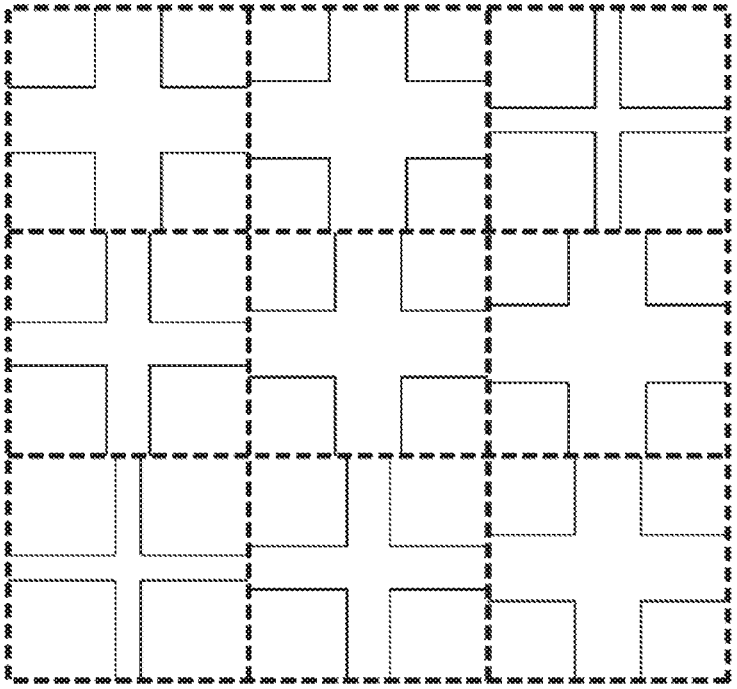
FIG. 11 is a diagram for explaining an example of a metal pattern.

FIG. 11 illustrates an example of a metal pattern of a metal pattern layer configuring the first phase control plate 11. As illustrated, metal patterns respectively corresponding to plural unit structures are provided in a single metal pattern layer. A metal pattern of the unit structure may be regarded as a combination of the inductance L extending in the x axis direction and the inductance L extending in y axis direction. The plurality of unit structures are different among each other in a width of a metal line or the like forming each unit structure. As mentioned above, different metal patterns are formed at different locations, and thus different admittances at different locations can be realized.

Figure 13A:
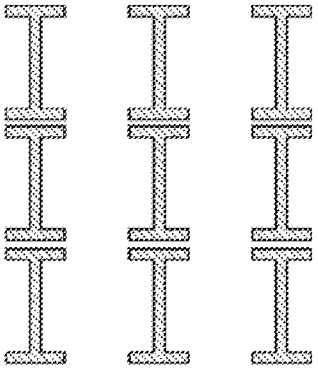
FIG. 13A is a diagram for explaining an example of a metal pattern.

Here, a description will be made of another example of a metal pattern of a metal pattern layer configuring the first phase control plate 11. In controlling an admittance value in a wide range from capacitance to inductance, a resonance circuit may be used, and FIGS. 13A-13D illustrate an example of a metal pattern for implementing a series resonance circuit. A metal pattern illustrated in FIG. 13A is configured by arranging plural linear metals (unit structures) disposed in the same direction as the x axis. The linear metal has line widths of both ends larger than other portions, and capacitance is formed between patterns adjacent to each other in the x axis direction. Note that both ends are not necessarily required to be wide, and may have the same thickness as that of the linear portion or may be thinner than the linear portion as long as a necessary capacitance value can be secured between the patterns adjacent to each other.

Figure 13B:
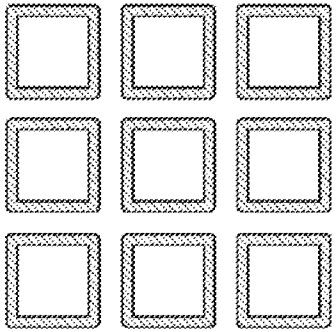
FIG. 13B is a diagram for explaining an example of a metal pattern.
Figure 13C:
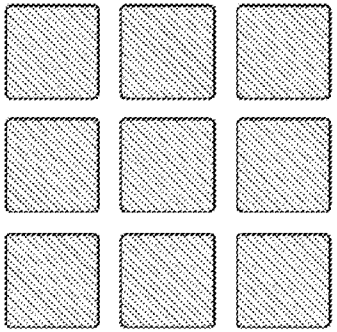
FIG. 13C is a diagram for explaining an example of a metal pattern.
Figure 13C:
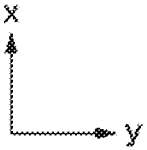
Figure 13D:
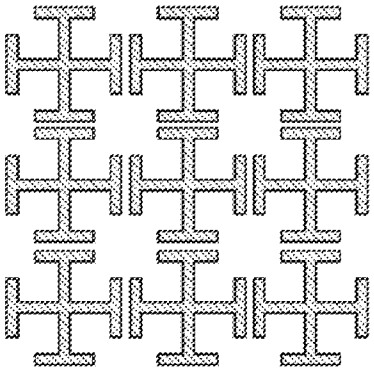
FIG. 13D is a diagram for explaining an example of a metal pattern.

FIG. 13B is a diagram illustrating a configuration of a metal pattern in which plural quadrangular annular metals (unit structures) each having a side in each of the same direction as and a direction perpendicular to the x axis are arranged. FIG. 13C is a diagram illustrating a configuration of a metal pattern in which plural quadrangular island-shaped metals (unit structures) each having a side in each of the same direction as and a direction perpendicular to the electric field E are arranged. FIG. 13D is a diagram illustrating a configuration of a metal pattern in which plural cross-shaped metals (unit structures) each having a side in each of the same direction as and a direction perpendicular to the electric field E are arranged.

Figure 14:
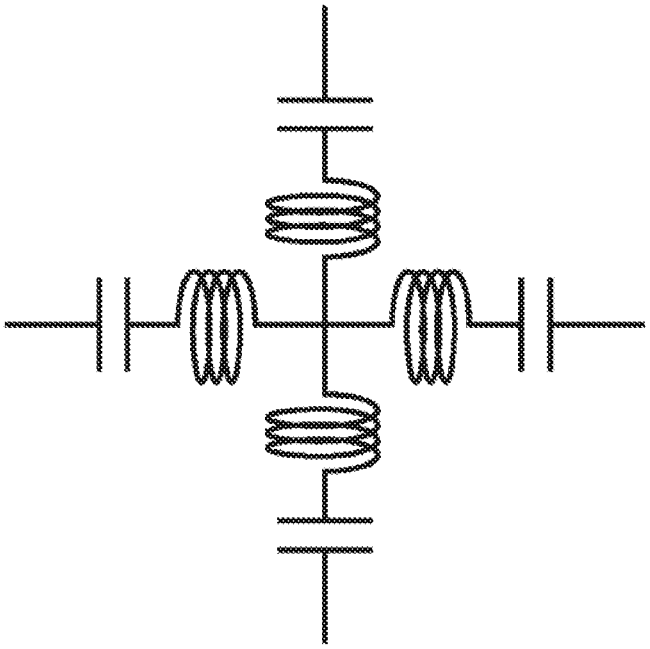
FIG. 14 is a diagram for explaining an example of an equivalent circuit to be achieved by a metal pattern of a single layer in a metal pattern layer.

Note that the metal patterns in FIGS. 13B to 13D are configured to perform the same action even in a case where a direction of the electric field E becomes any direction in the xy plane in the figure. A two-dimensional equivalent circuit in this case is as illustrated in FIG. 14.

Figure 16C:
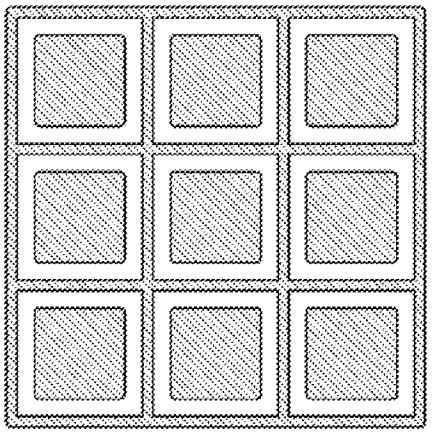
FIG. 16C is a diagram for explaining an example of a metal pattern.
Figure 16B:
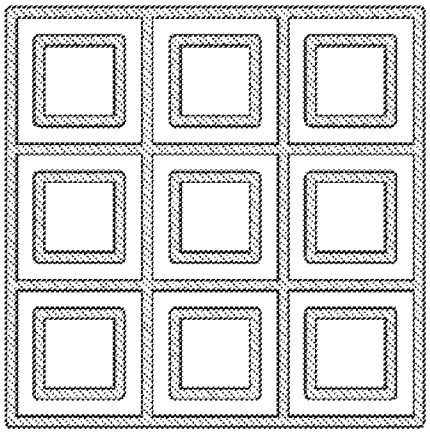
FIG. 16B is a diagram for explaining an example of a metal pattern.
Figure 16A:
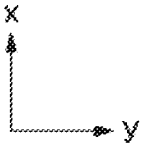
FIG. 16A is a diagram for explaining an example of a metal pattern.
Figure 16A:
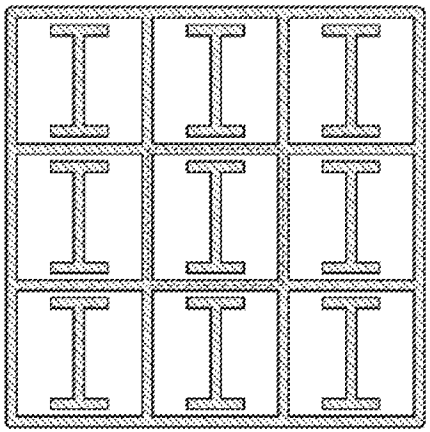
Figure 16D:
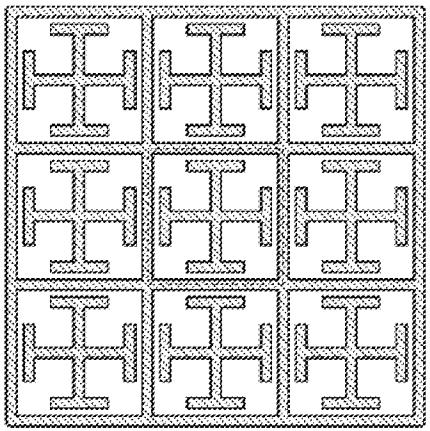
FIG. 16D is a diagram for explaining an example of a metal pattern.

Here, a description will be made of still another example of a metal pattern of a metal pattern layer configuring the first phase control plate 11. FIGS. 16A-16D illustrate an example of a metal pattern for implementing a parallel resonance circuit. FIG. 16A is a diagram illustrating a configuration of a metal pattern in which each of the plurality of linear metals in the metal pattern illustrated in FIG. 13A is surrounded by an annular metal having a side in each of the same directions as the x axis and the y axis. FIG. 16B is a diagram illustrating a configuration of a metal pattern in which each of the plurality of quadrangular annular metals in the metal pattern illustrated in FIG. 13B is surrounded by an annular metal having a side in each of the same directions as the x axis and the y axis. FIG. 16C is a diagram illustrating a configuration of a metal pattern in which each of the plurality of quadrangular island-shaped metals in the metal pattern illustrated in FIG. 13C is surrounded by an annular metal having a side in each of the same directions as the x axis and the y axis. FIG. 16D is a diagram illustrating a configuration of a metal pattern in which each of the plurality of cross-shaped metals in the metal pattern illustrated in FIG. 13D is surrounded by an annular metal having a side in each of the same directions as the x axis and the y axis. In FIGS. 16A to 16D, each of plural annular metals surrounding the internal metals illustrated in FIGS. 13A to 13D shares one side with an annular metal adjacent thereto.

Figure 15:
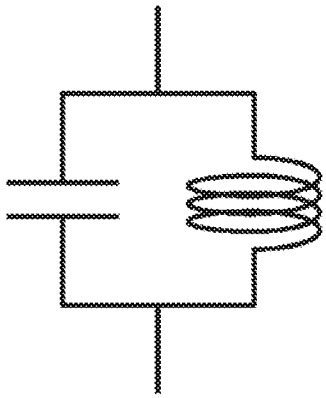
FIG. 15 is a diagram for explaining an example of an equivalent circuit to be achieved by a metal pattern of a single layer in a metal pattern layer.

Each of the metal patterns illustrated in FIGS. 16A to 16D acts as a parallel resonance circuit due to the inductance L formed by the annular metal and a series resonator portion in which the capacitance C formed as a result of the annular metal and the metal pattern inside the annular metal being adjacent to each other, the inductance L formed by the metal pattern inside the annular metal, and the capacitance C formed as a result of the annular metal and the metal pattern inside the annular metal being adjacent to each other are connected in series to each other in this order in the vertical direction in the figure. Above all, the series resonator portion in which C, L, and C are connected in series to each other operates as a capacitor up to a resonance frequency of a series resonator. Thus, all of the metal patterns in FIGS. 16A to 16D come to an equivalent circuit illustrated in FIG. 15. In other words, all of the metal patterns in FIGS. 16A to 16D realize the equivalent circuit having the relationship illustrated in FIG. 15, that is, a parallel resonance circuit.

Figure 17:
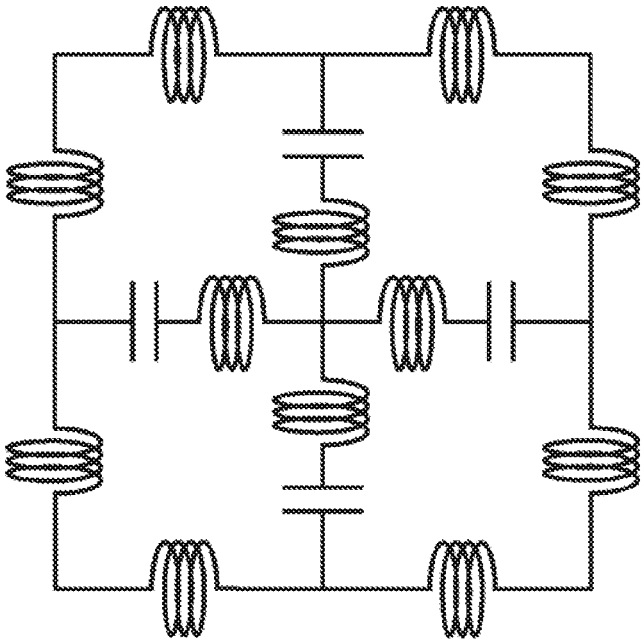
FIG. 17 is a diagram for explaining an example of an equivalent circuit to be achieved by a metal pattern of a single layer in a metal pattern layer.

Note that the metal patterns in FIGS. 16B to 16D are configured to perform the same action even in a case where a direction of the electric field E becomes any direction in the xy plane in the figure. A two-dimensional equivalent circuit in this case is as illustrated in FIG. 17.

The metal patterns illustrated in FIGS. 13 and 16 are configured by arranging plural unit structures having an identical shape, but the first phase control plate 11 is configured by arranging plural different types of unit structures having different lengths of metal lines, thicknesses of metal lines, gaps between metal lines, areas of metal portions, and the like.

Figure 18:
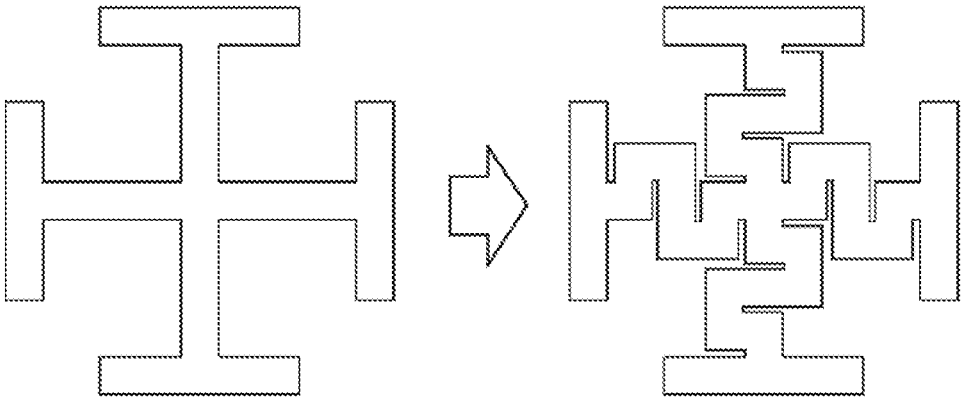
FIG. 18 is a diagram for explaining an example of a metal pattern.
Figure 19:
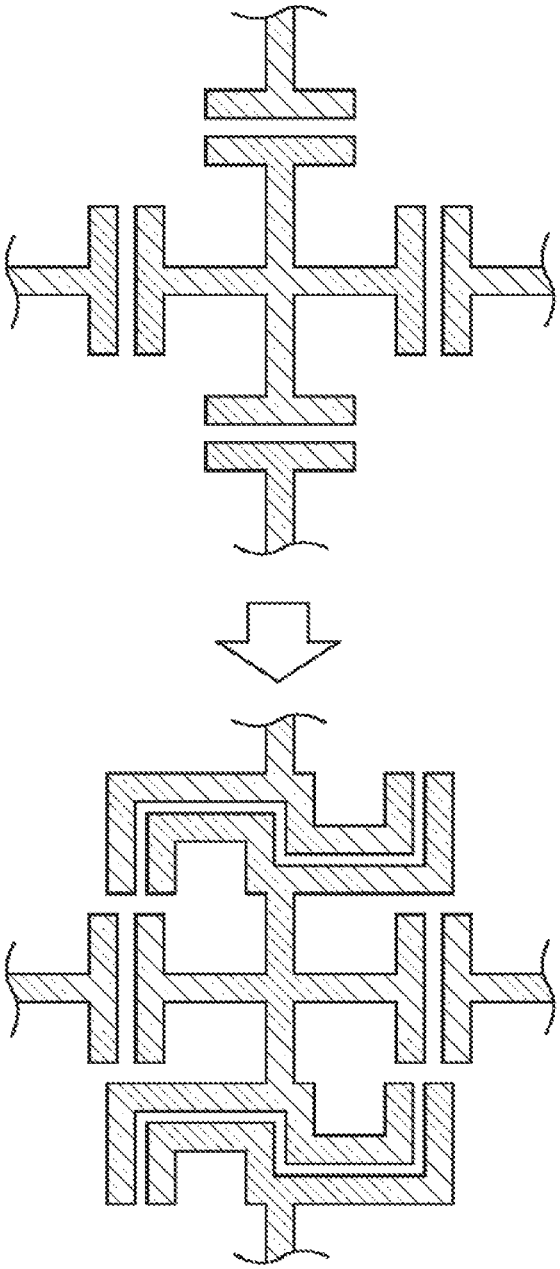
FIG. 19 is a diagram for explaining an example of a metal pattern.

In designing the metal pattern layer, C may be increased by using, for example, an inter-digital capacitor as a capacitor portion. L may be increased by using, for example, a meander inductor or a spiral inductor as an inductor portion. FIG. 18 illustrates a modification example of the cross-shaped metal in FIGS. 13D and 16D. FIG. 19 illustrates a modification example of the cross-shaped metal in FIG. 13D. In FIG. 18, the linear metal pattern is modified into a meander-shaped metal pattern, and thus an effect that L is increased can be expected, and, in FIG. 19, the facing metal patterns are modified into metal patterns in an inter-digital form, and thus an effect that C is increased can be expected.

Next, a description will be made of an example of a unit structure of a metal pattern layer configuring the first phase control plate 11 with reference to FIGS. 20 and 21. Unit structures in FIGS. 20 and 21 are formed by laminating plural layers having the metal patterns. FIGS. 20 and 21 illustrate examples of unit structures formed by laminating three layers. In other words, a unit structure is formed by a combination of three laminated metal patterns. Note that the three-layer structure is merely an example, and the metal pattern layer may be formed of four or more layers. There is concern that a loss increases due to impedance matching with air, but the metal pattern layer may be formed of a single layer or two layers. A unit structure of the metal pattern layer may be configured with plural types of metal patterns as illustrated in FIGS. 20 and 21.

Figure 20A:
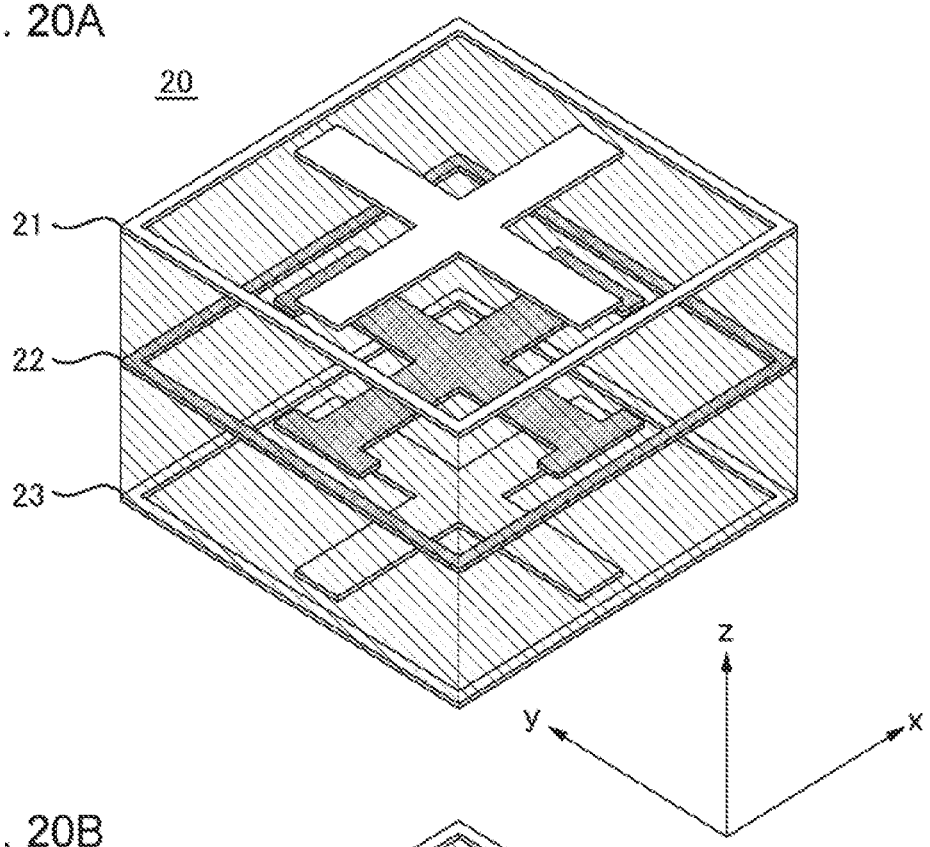
FIG. 20A is a diagram for explaining an example of a unit structure.
Figure 20B:
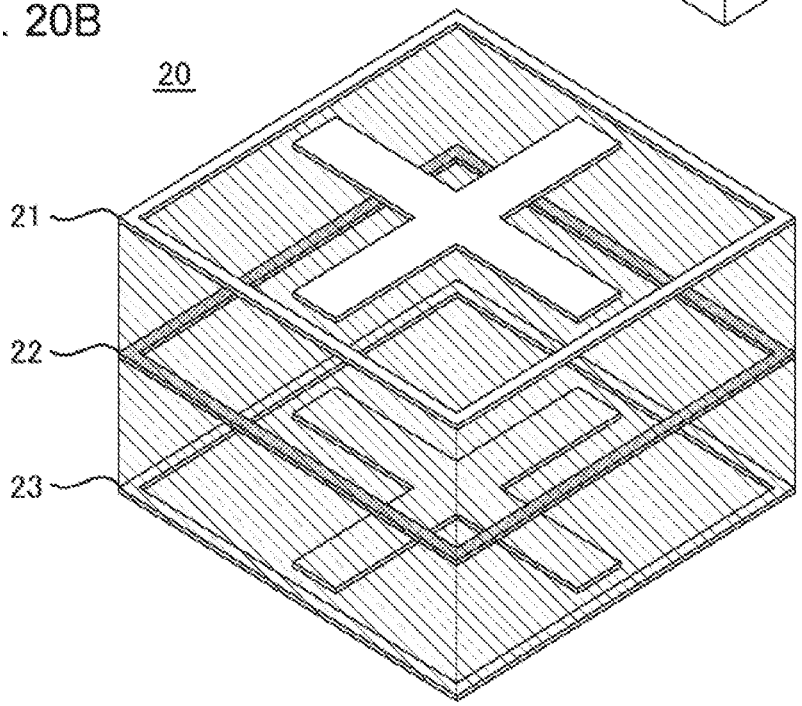
FIG. 20B is a diagram for explaining an example of a unit structure.

FIGS. 20A-20B illustrate an example of a parallel-resonator-type unit structure 20. The unit structure 20 in FIG. 20A is configured with a metal pattern 21 of the first layer, a metal pattern 22 of the second layer, and a metal pattern 23 of the third layer. The metal pattern 21 of the first layer includes an outer peripheral metal surrounding the outer periphery and a cross-shaped internal metal located therein. The outer peripheral metal and the internal metal are insulated from each other. The metal pattern 22 of the second layer includes an outer peripheral metal surrounding the outer periphery and a cross-shaped internal metal located therein. A line width of each end of the two linear metals forming the cross shape is large. The outer peripheral metal and the internal metal are insulated from each other. The metal pattern 23 of the third layer includes an outer peripheral metal surrounding the outer periphery and a cross-shaped internal metal located therein. The outer peripheral metal and the internal metal are insulated from each other. The metal pattern 21 of the first layer to the metal pattern 23 of the third layer are insulated among each other. A location where a metal pattern is not present is buried with, for example, a dielectric.

The unit structure 20 in FIG. 20B is also configured with a metal pattern 21 of the first layer, a metal pattern 22 of the second layer, and a metal pattern 23 of the third layer. The metal pattern 21 of the first layer includes an outer peripheral metal surrounding the outer periphery and a cross-shaped internal metal located therein. The outer peripheral metal and the internal metal are insulated from each other. The metal pattern 22 of the second layer includes an outer peripheral metal surrounding the outer periphery. The metal pattern 23 of the third layer includes an outer peripheral metal surrounding the outer periphery and a cross-shaped internal metal located therein. The outer peripheral metal and the internal metal are insulated from each other. The metal pattern 21 of the first layer to the metal pattern 23 of the third layer are insulated among each other. A location where a metal pattern is not present is buried with, for example, a dielectric.

Figure 21A:
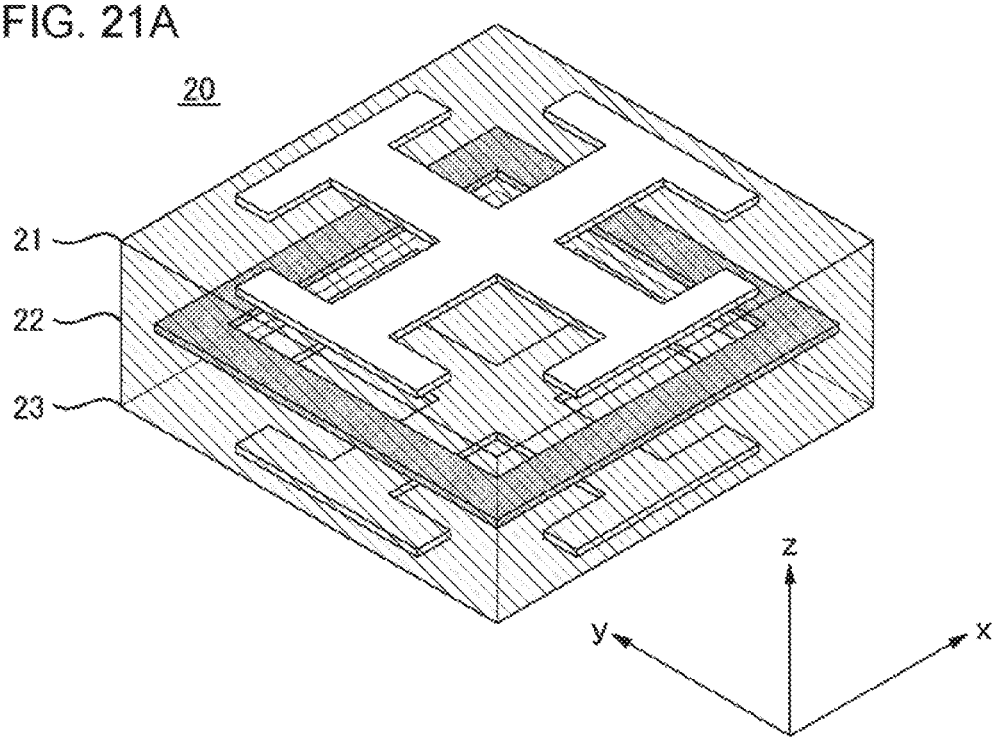
FIG. 21A is a diagram for explaining an example of a unit structure.
Figure 21B:
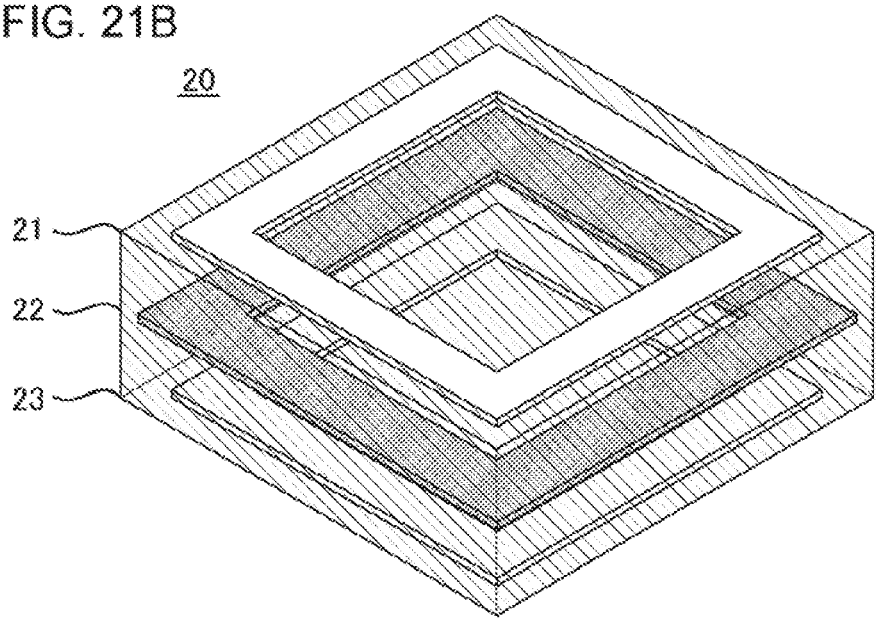
FIG. 21B is a diagram for explaining an example of a unit structure.

FIGS. 21A-21B illustrate an example of a series-resonator-type unit structure 20. The unit structure 20 in FIG. 21A is configured with a metal pattern 21 of the first layer, a metal pattern 22 of the second layer, and a metal pattern 23 of the third layer. The metal pattern 21 of the first layer includes a cross-shaped internal metal, and a line width of each end of the two linear metals forming the cross shape is large. The metal pattern 22 of the second layer includes a quadrangular annular metal. The metal pattern 23 of the third layer includes a cross-shaped internal metal, and a line width of each end of the two linear metals forming the cross shape is large. The metal pattern 21 of the first layer to the metal pattern 23 of the third layer are insulated among each other. A location where a metal pattern is not present is buried with, for example, a dielectric.

The unit structure 20 in FIG. 21B is also configured with a metal pattern 21 of the first layer, a metal pattern 22 of the second layer, and a metal pattern 23 of the third layer. Each of the metal pattern 21 of the first layer, the metal pattern 22 of the second layer, and the metal pattern 23 of the third layer includes a quadrangular annular metal. The metal pattern 21 of the first layer to the metal pattern 23 of the third layer are insulated among each other. A location where a metal pattern is not present is buried with, for example, a dielectric.

Next, a description will be made of a method of arranging plural unit structures 20 in a metal pattern layer. FIG. 22 schematically illustrates the example. FIG. 22 is a view in which the first phase control plate 11 in FIG. 1 is observed from the z direction in the figure. In FIG. 22, a part of a front surface of a metal pattern layer of the first phase control plate 11 is displayed to be enlarged, and a planar shape of the unit structure 20 and an arrangement method are illustrated. The unit structure 20 is schematically illustrated, and a metal pattern is not illustrated.

In the example illustrated in FIG. 22, a planar shape of the unit structure 20 is a square shape. Plural unit structures 20 are arranged regularly without any gap and linearly vertically and horizontally in a grid shape (matrix form). FIG. 23 illustrates another example. Also in the example illustrated in FIG. 23, a planar shape of the unit structure 20 is a square shape. In the example illustrated in FIG. 23, the unit structures are arranged in a zigzag shape in which columns of unit structure vertically adjacent to each other are deviated from each other by a predetermined amount (for example, a half of a length of one side of the unit structure).

A planar shape of the unit structure 20 is not limited to the illustrated square shape, and may be other shapes (for example, other polygonal shapes such as an equilateral triangular shape or a regular hexagonal shape (refer to FIG. 25)). A method of arranging plural unit structures 20 is not limited to the grid shape or a zigzag shape as illustrated. However, in a case where ease of design is considered, plural unit structures 20 are preferably regularly arranged. In the illustrated example, a planar shape of the first phase control plate 11 is a circular shape, but may be other shapes.

Note that FIGS. 22 and 23 are schematic diagrams for merely explaining a planar shape of the unit structure 20 and an arrangement method, and a relationship between a size of a planar shape of the first phase control plate 11 and a size of a planar shape of the unit structure 20, illustrated, has no particular meaning.

However, in a case where an angle formed between the central axis and the front surface of the metal pattern layer is different from 90 degrees, a unit structure group deviating phases of transmitted electromagnetic waves by an identical amount surrounds the periphery of the representative point, for example, in such a shape in which a circle centering on the representative point is stretched toward one side, and an opposite side thereof is pressed with the circle center interposed therebetween. Plural types of unit structure groups deviating phases of transmitted electromagnetic waves by different amounts surround the periphery of the representative point in an identical shape and with different diameters. A surrounding shape in this case is defined according to, for example, a direction in which the central axis is tilted with respect to the metal pattern layer or an angle formed therebetween.

According to the above-described communication apparatus 1 of the present example embodiment, the radio wave radiation source 10 is configured with the slot opening 10A and the conductive plate 10B, and thus it is possible to realize a low directivity feature of being capable of supplying power up to a radius region of the first phase control plate 11 corresponding to $L_1/2$, and, more preferably, up to a radius region corresponding to $L_1$. Consequently, power of an electromagnetic wave can be supplied even to the first phase control plate 11 disposed at a short distance from the radio wave radiation portion (the slot opening 10A in the present example embodiment) of the radio wave radiation source in a wide range of the first phase control plate 11, and thus a high-directivity beam can be formed. In other words, the communication apparatus 1 forming a high-directivity beam can be implemented with a thin configuration.

According to the first phase control plate 11 using the above-described meta-surface, thinning of the lens portion is also realized. Phases of electromagnetic waves are aligned with each other by using the first phase control plate 11 including the metal pattern layer. As a result, the first phase control plate 11 can be thinned compared with a case of using a general lens. For example, a thickness of the first phase control plate 11 is generally a half or less of a wavelength at an operation frequency of the communication apparatus, and is equal to or less than the wavelength even when the thickness is large, and the numerical value range can be maintained regardless of the size of a surface area. For example, in a case where 60 GHz is supposed, the thickness thereof is 2.5 mm or less, and is 5 mm or less even when the thickness is large.

Figure 10:
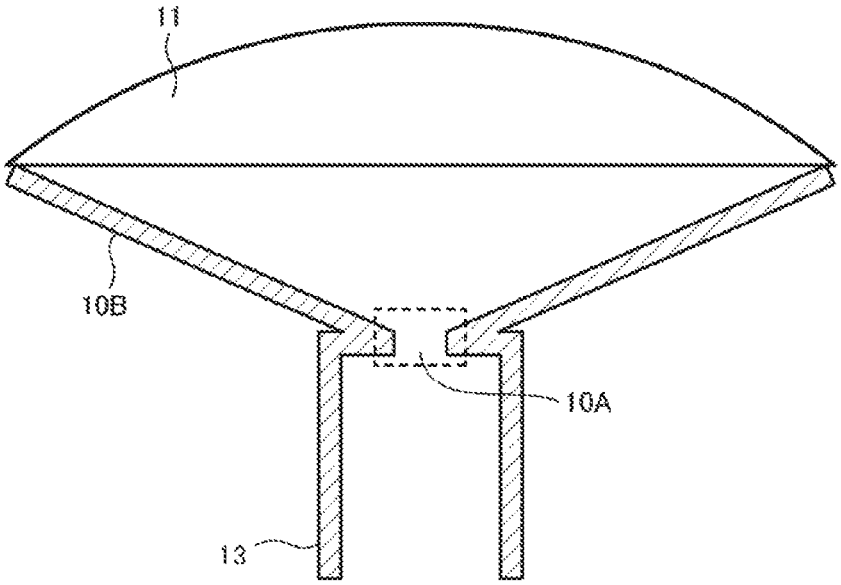
FIG. 10 is an example of a sectional schematic diagram of the communication apparatus of the present example embodiment.

Although an aspect of using a meta-surface as the first phase control plate 11 has been described hitherto, a dielectric lens may be used as the first phase control plate 11 as illustrated in FIG. 10. In this case, a thickness of the first phase control plate 11 is a thickness of the dielectric lens, but a distance between a radio wave radiation portion (the slot opening 10A in the present example embodiment) of the radio wave radiation source and the first phase control plate 11 can be reduced, and thus it is possible to realize thinning of the communication apparatus 1.

In the present example embodiment, a size of the emission surface of the first phase control plate 11 can be made a sufficient size while realizing thinning of the communication apparatus 1. Thus, it is possible to realize high directivity of an electromagnetic wave.

Second Example Embodiment

Figure 27A:
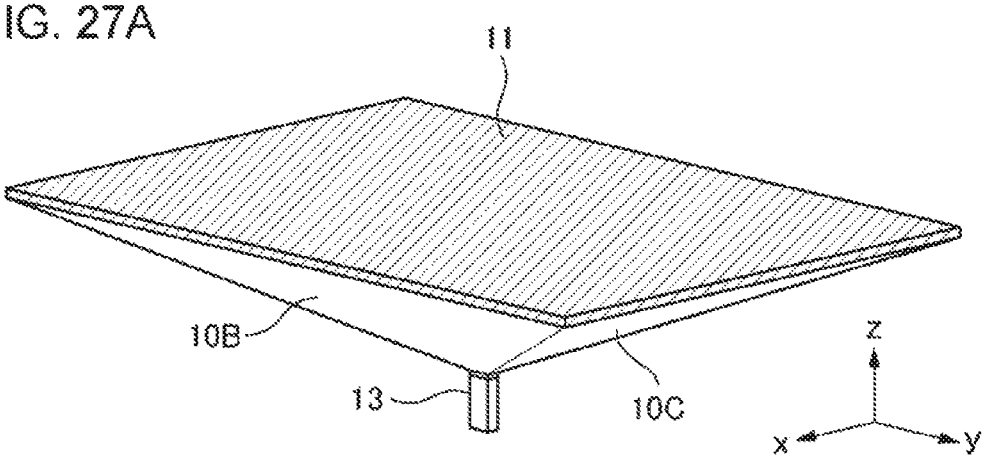
FIG. 27A is an example of the overall schematic diagram of the communication apparatus of the present example embodiment.
Figure 27B:
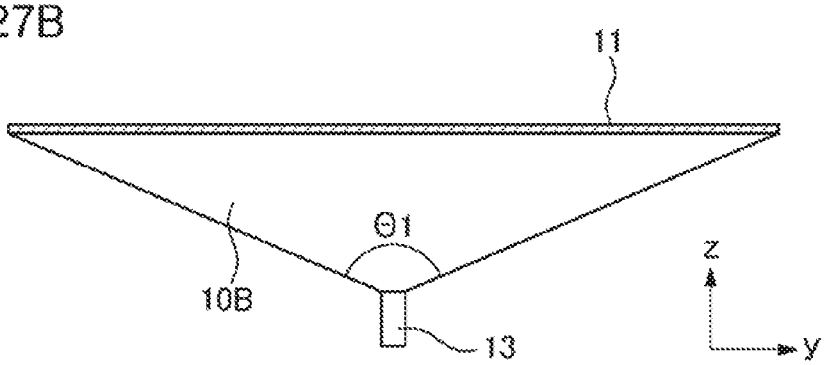
FIG. 27B is an example of the overall schematic diagram of the communication apparatus of the present example embodiment.
Figure 27C:
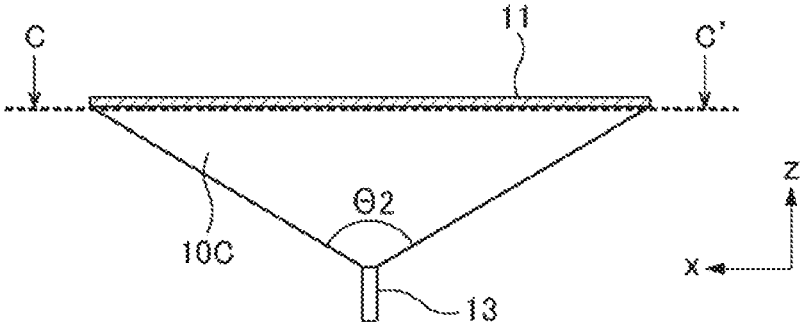
FIG. 27C is an example of the overall schematic diagram of the communication apparatus of the present example embodiment.

FIG. 27A is another example of a perspective view of a communication apparatus 1 of the present example embodiment. FIG. 27B is a view in which the communication apparatus 1 in FIG. 27A is observed in the x direction in the figure. FIG. 27C is a view in which the communication apparatus 1 in FIG. 27A is observed in the y direction in the figure.

Figure 8:
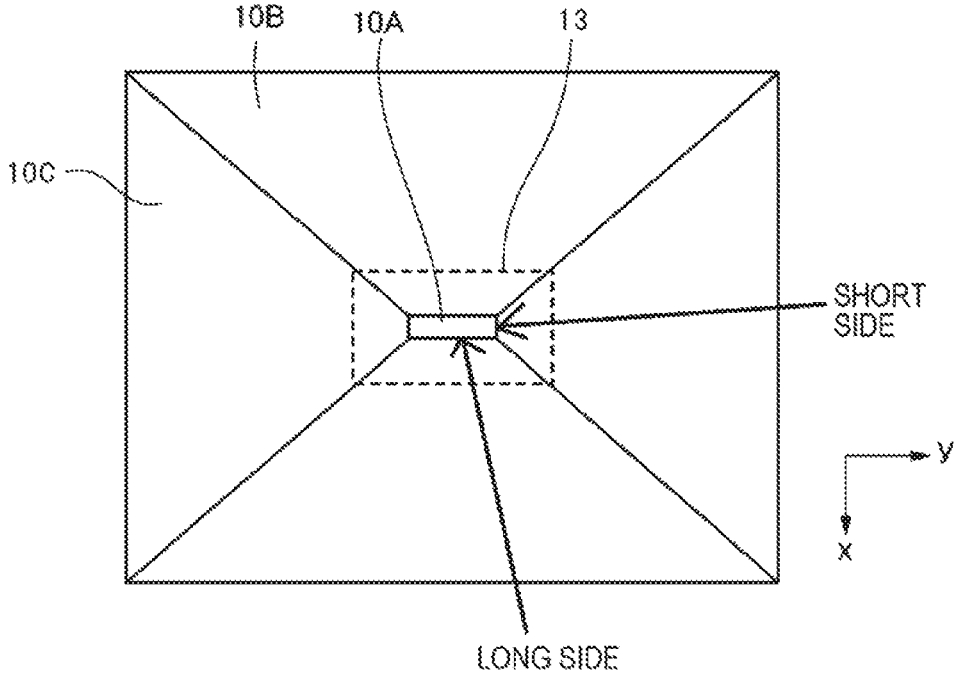
FIG. 8 is an example of a planar schematic diagram of the communication apparatus of the present example embodiment.

As illustrated, the communication apparatus 1 of the present example embodiment includes a conductive plate 10C connecting the short side (refer to FIG. 8) of the slot opening 10A to the first phase control plate 11 in addition to the conductive plate 10B of the first example embodiment. Each of the conductive plate 10B and the conductive plate 10C has a diameter which gradually increases from the slot opening 10A toward the first phase control plate 11. In a case of the example illustrated in FIGS. 27A-27C, as illustrated in FIGS. 27B and 27C, both of the x direction and the y direction are blocked by the conductive plate 10B or the conductive plate 10C.

FIGS. 27A-27C illustrate an example in which the short side of the slot opening 10A and the conductive plate 10C are directly connected to each other, but the slot opening 10A and the conductive plate 10C may not be directly connected to each other. For example, the slot opening 10A and the conductive plate 10C may be connected to each other through another conductive plate. FIG. 27A-27C illustrate a case where the conductive plate 10C is a flat plate, but the conductive plate 10C is not necessarily required to be a flat plate, and may have a curvature.

Figure 28:
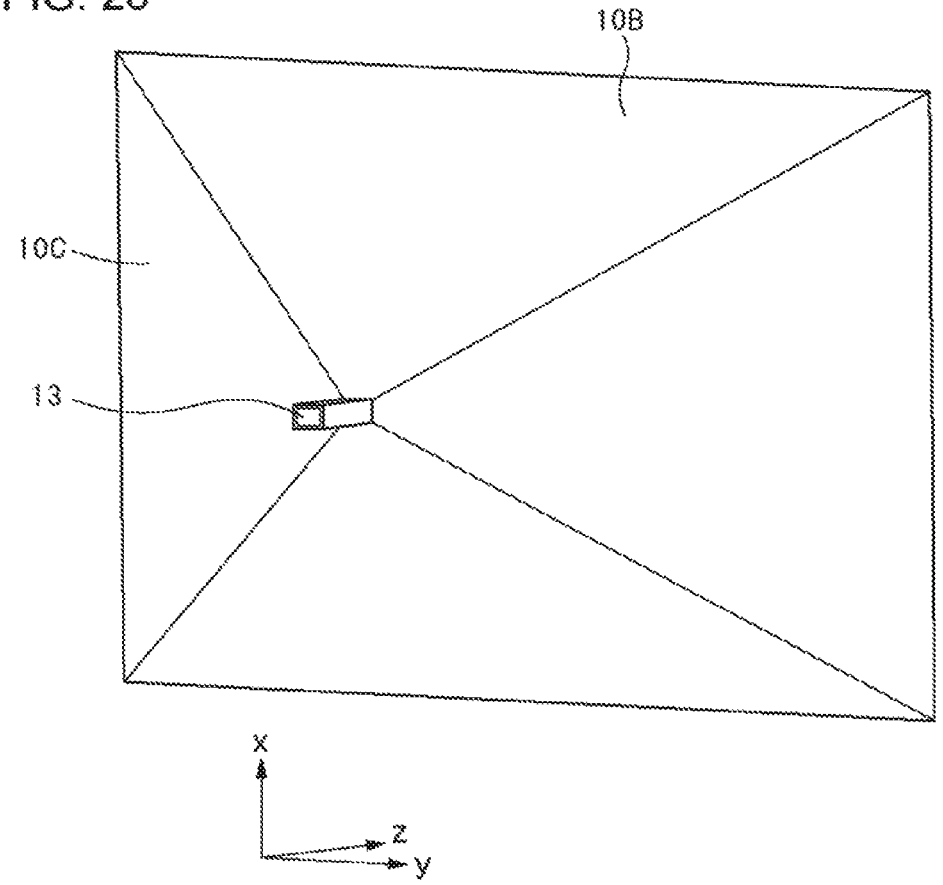
FIG. 28 is an example of the overall perspective view of the communication apparatus of the present example embodiment.
Figures 29A, 29B:
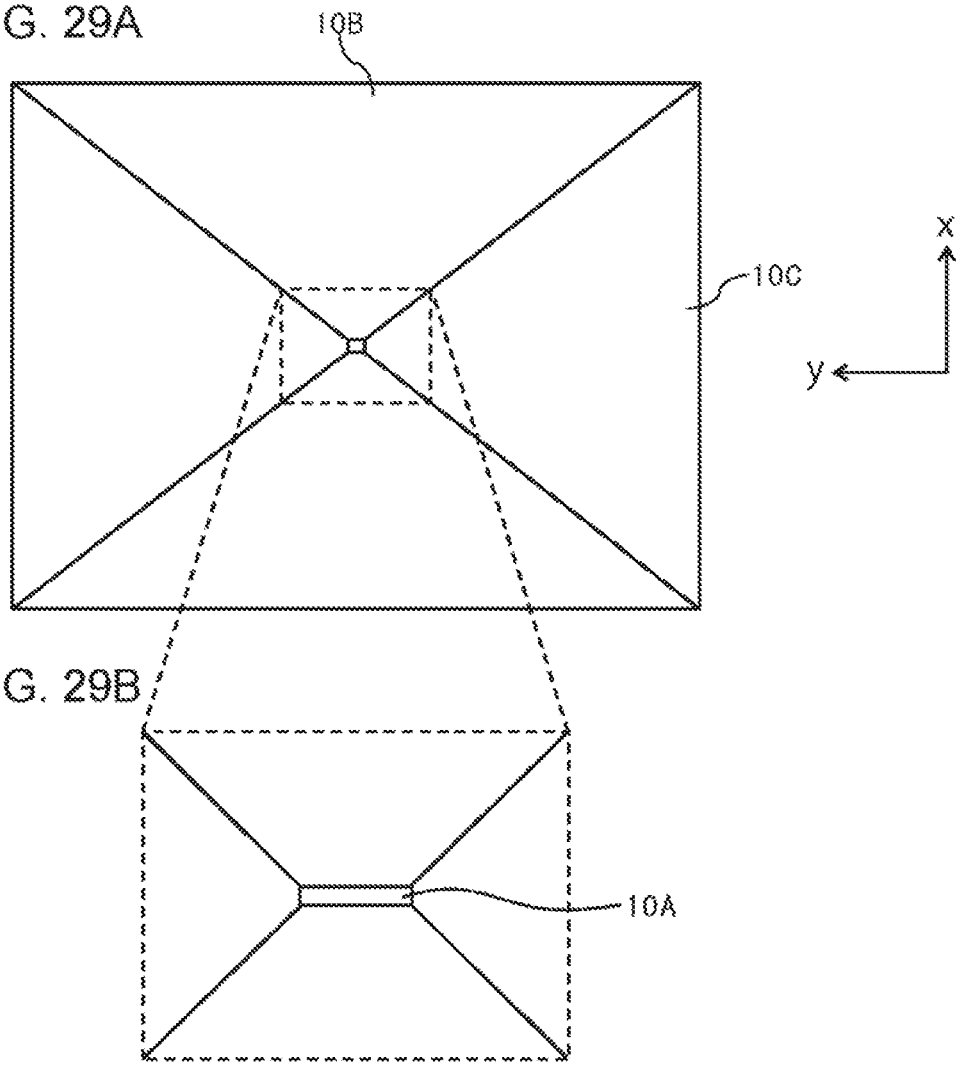
FIG. 29A is a diagram for explaining an example of the entire image of the communication apparatus of the present example embodiment.
FIG. 29B is a diagram for explaining an example of the entire image of the communication apparatus of the present example embodiment.

FIG. 28 is an example of a view in which the communication apparatus 1 in FIGS. 27A-27C is obliquely observed from the bottom in the figure. FIG. 29A is an example of a plan view in which the communication apparatus 1 is observed from the opening sides of the conductive plates 10B and 10C in a state in which the first phase control plate 11 is omitted. FIG. 29B is an enlarged view of a portion surrounded by a dashed line in FIG. 29A. The slot opening 10A of the radio wave radiation source 10 is displayed in the portion surrounded by the dashed line. An electromagnetic wave emitted from the slot opening 10A advances through the inside surrounded by the conductive plates 10B and 10C. The electromagnetic wave is incident to the first phase control plate 11 (not illustrated) located at an opening portion of the conductive plates 10B and 10C.

According to the communication apparatus 1 of the present example embodiment, it is possible to prevent an electromagnetic wave from leaking outward of the first phase control plate 11 as a result of being covered with the conductive plates 10B and 10C. In the communication apparatus 1 of the present example embodiment, an angle θ1 formed between two conductive plates 10B is preferably larger than an angle θ2 formed between two conductive plates 10C.

The figures illustrate the radio wave radiation source 10 including the slot opening 10A as an example, but the radio wave radiation source 10 is not limited to such a configuration as long as the low directivity feature required for the present invention is provided. For example, in a case where a dipole antenna is disposed to be substantially parallel to the first phase control plate 11 power scatters in an opposite direction to the first phase control plate 11 but the dipole antenna has the low direction feature required for the radio wave radiation source 10 of the present invention. Other low-directivity antennas may be used as the radio wave radiation source 10. The modification may be applied to all other example embodiments.

Third Example Embodiment

Figure 33:
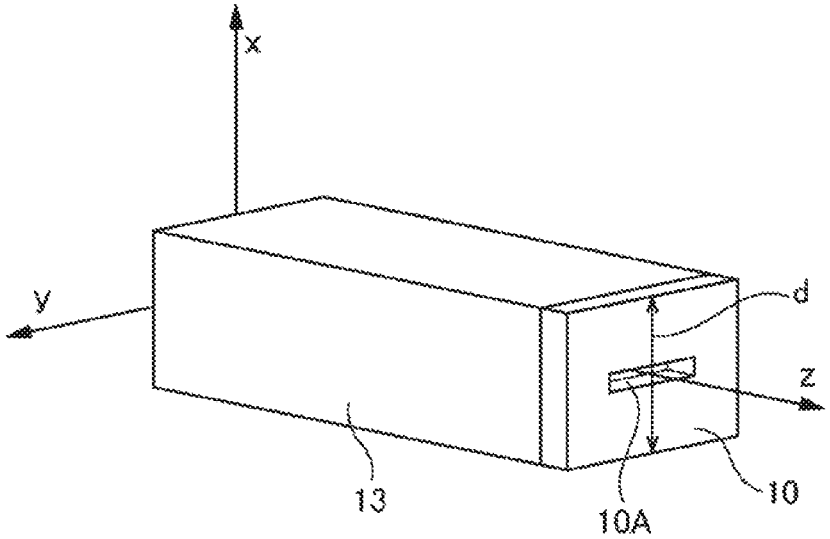
FIG. 33 is a diagram for explaining an example of a radio wave radiation source of the communication apparatus of the present example embodiment.

FIG. 33 illustrates a configuration of the radio wave radiation source 10 of the present example embodiment. The communication apparatus 1 of the present example embodiment may not include the conductive plates 10B and 10C described in the first and second example embodiments.

Figure 5:
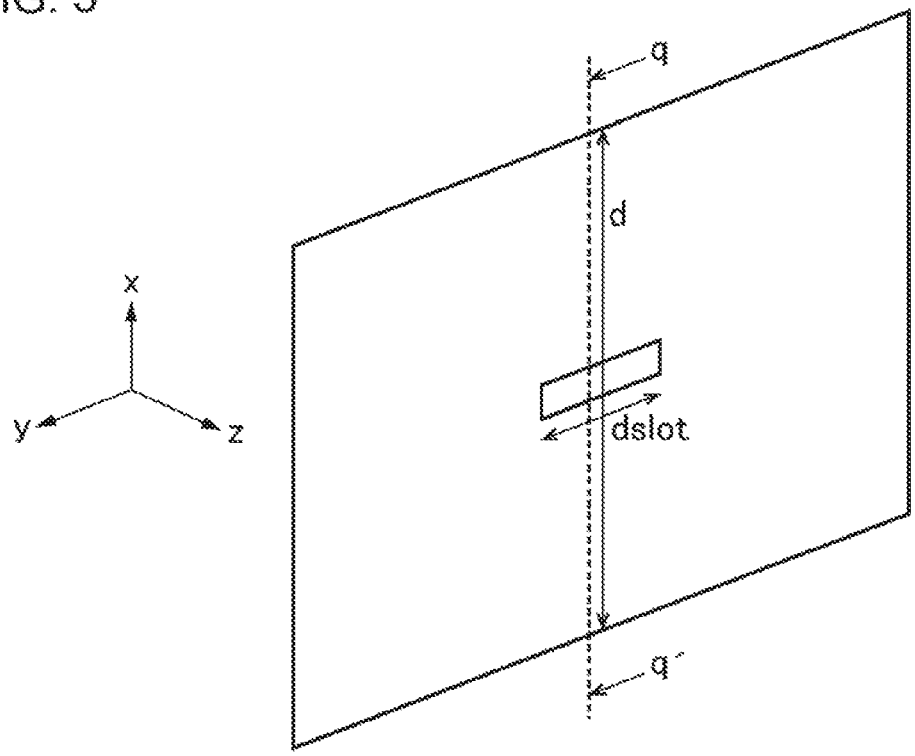
FIG. 5 is a diagram for explaining a reference example.
Figure 6:
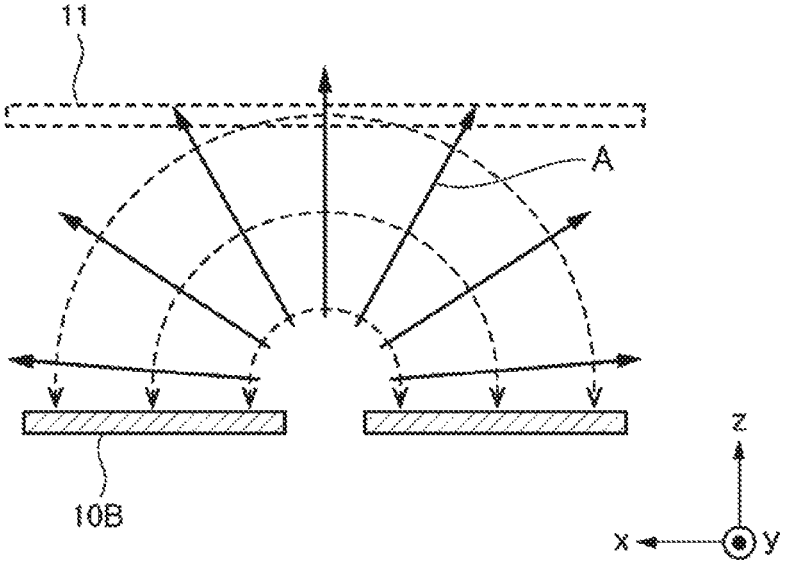
FIG. 6 is a diagram for explaining the reference example.
Figure 26:
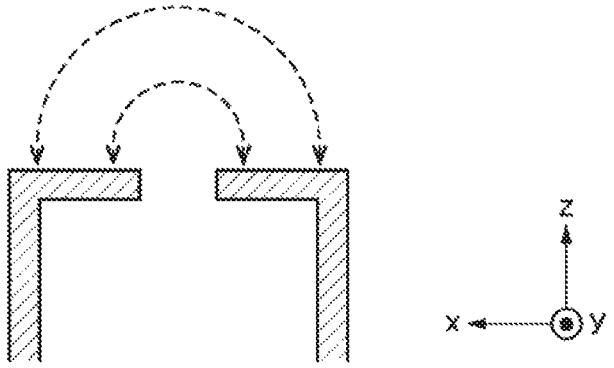
FIG. 26 is a diagram for explaining the communication apparatus of the present example embodiment.

Here, as illustrated in FIG. 5, in a case where the slot opening 10A is cut on a plane, a length d in the figure is required to be small. Here, d indicates a diameter of a face having the slot opening 10A, and is a diameter in a direction perpendicular to the long side of the slot opening 10A. The illustrated dslot indicates a slot length (a length of the long side of the slot). For example, d is preferably dslot×10 or less, and is more preferably dslot×5 or less. In a case where d in the figure is large, as described in the first example embodiment, power of an electromagnetic wave scatters in the x axis direction and the −x axis direction, and thus the power cannot be efficiently introduced into the first phase control plate 11. In a case where d in the figure is small, a metal boundary in the x axis direction is broken (refer to FIG. 26), and thus a radio wave is not radiated in the x axis direction and the −x axis direction.

The radio wave radiation source 10 of the present example embodiment includes the slot opening 10A having a rectangular shape which is open in the disposition direction of the first phase control plate 11. A length of the diameter d of a conductive plate in which the slot opening 10A is formed, orthogonal to the long side of the slot opening 10A, is ten times or less the length of the long side of the slot opening 10A, and is more preferably five times or less. In this case, a radio wave can be efficiently introduced into the first phase control plate 11.

FIG. 33 illustrates a case where the radio wave radiation source 10 or the power supply portion 13 is not connected to a casing or the like, but the radio wave radiation source 10 or the power supply portion 13 may be connected to a casing. For example, a casing made of a metal or a dielectric may be provided such that a sidewall of the power supply portion 13 is connected to the phase control plate 11.

Fourth Example Embodiment

Figure 24:
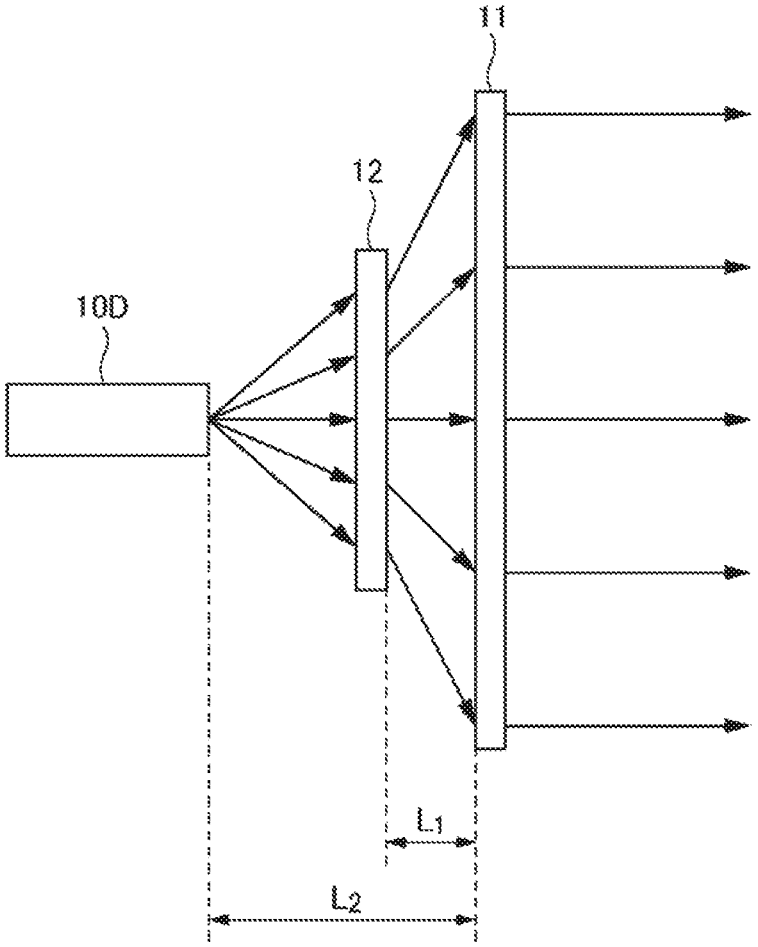
FIG. 24 is an example of the overall schematic diagram of the communication apparatus of the present example embodiment.

FIG. 24 is a schematic diagram illustrating a communication apparatus 1 of the present example embodiment. The communication apparatus 1 is, for example, an antenna apparatus (for example, a millimeter-wave antenna). As illustrated, the communication apparatus 1 includes a radio wave radiation source 10D, a first phase control plate 11, and a second phase control plate 12. In FIG. 24, an arrow A indicates an advancing direction of an electromagnetic wave. Advancing directions of electromagnetic waves radiated from the radio wave radiation source 10D are widened by the second phase control plate 12. Phases of the electromagnetic waves are aligned with each other by the first phase control plate 11. In the present example embodiment, even though the radio wave radiation source 10D has a relatively high directivity, the directivity is lowered by the second phase control plate 12, and thus thinning of the communication apparatus 1 is realized. In other words, according to the present example embodiment, the radio wave radiation source 10D is regarded as the radio wave radiation source 10 along with the second phase control plate 12, and thus the low directivity feature required for the radio wave radiation source is realized. The low directivity feature mentioned here is a directivity in which power can be supplied to the first phase control plate 11 disposed at a position of the distance $L_1$ from the radio wave radiation source (in the present example embodiment, $L_1$ illustrated in FIG. 24 since the radio wave radiation source is configured with the radio wave radiation source 10D and the second phase control plate 12) up to a radius region corresponding to $L_1/2$. In a case where the radio wave radiation source 10D is a single body, and has the low directivity feature, the second phase control plate 12 realizes a function of further reducing a distance between the radio wave radiation source 10D and the first phase control plate 11 such that the communication apparatus 1 is further miniaturized. Hereinafter, details thereof will be described.

The second phase control plate 12 is located between the radio wave radiation source 10D and the first phase control plate 11. An electromagnetic wave radiated from the radio wave radiation source 10D is transmitted through the second phase control plate 12, and is then transmitted through the first phase control plate 11. The second phase control plate 12 includes, for example, a metal pattern layer which is a meta-surface (an artificial sheet-like material formed by using the concept of meta-material) and is formed of one or plural layers, and a phase of a transmitted electromagnetic waves differs according to a distance from a representative point on the metal pattern layer.

The metal pattern layer has a structure in which plural types of unit structures configured to include metals are arranged regularly with a predetermined rule or at random. A size of the unit structure is sufficiently smaller than a wavelength of an electromagnetic wave. Thus, a set of unit structures functions as an electromagnetic continuous medium. Permeability and a dielectric constant are control by using a structure of a metal pattern, and thus a refractive index (phase velocity) and impedance can be controlled separately.

An example of a structure for controlling permeability, an example of a structure for controlling a dielectric constant, an example of a metal pattern of a metal pattern layer of which impedance (admittance) is controlled, an example of a layer having a metal pattern, an example of a unit structure formed by laminating plural layers having metal patterns, an example of a method of arranging plural unit structures 20 in a single metal pattern layer, and the like are the same as described in relation to the first phase control plate 11 in the first example embodiment. A planar shape of the second phase control plate 12 is, for example, a circular shape, but is not limited thereto. Note that a size of the front surface of the second phase control plate 12 is preferably smaller than a size of the front surface of the first phase control plate 11, but a size of the front surface of the second phase control plate 12 is not necessarily required to be smaller than a size of the front surface of the first phase control plate 11.

The second phase control plate 12 is configured by arranging unit structures giving different phase delays according to distances from a representative point on a metal pattern layer. The "representative point" is a point on a front surface (a surface facing the radio wave radiation source 10) of the metal pattern layer of the second phase control plate 12. The "distance from the representative point" is a distance from the representative point on the front surface. Specifically, the metal pattern layer of the second phase control plate 12 is configured by arranging unit structures giving a larger phase delay amount toward an edge of the phase control plate from the representative point. The description is made supposing that a phase range is not limited to a range of 360 degrees. The function is realized by arranging plural types of unit structures having different performances in a predetermined order. Hereinafter, a description thereof will be made.

A radio wave reaching a point on the second phase control plate 12 closest to a radio wave radiation portion of the radio wave radiation source 10D reaches the second phase control plate 12 at the shortest optical path length. The point on the second phase control plate 12 closest to the radio wave radiation portion is set as the representative point, and the second phase control plate 12 is formed to give different phase delays according to distances from the representative point on the phase control plate 12. The representative point is preferably located near the center of a front surface of the second phase control plate 12.

When in electromagnetic waves which are radiated with a spread in a width direction toward the second phase control plate 12 from the radio wave radiation source 10D, a line passing through the center of the spread in the width direction of the electromagnetic waves is referred to as a central axis, an angle formed between the central axis and the surface of the metal pattern layer is larger than 0 degrees, and is smaller than 180 degrees.

In the metal pattern layer for realizing the function, a unit structure group giving an identical phase delay to transmitted electromagnetic waves surrounds the periphery of the representative point. Each of plural types of unit structure groups giving different phase delay amounts to transmitted electromagnetic waves surrounds the periphery of the representative point. Note that the "identical amount" is a concept including not only completely matching but also an amount including an error (a variation in a phase delay amount due to a processing error, an etching error, or the like). A difference in a phase amount deviated between unit structures of a unit structure group deviating phases of transmitted electromagnetic waves by an identical amount is, for example, 45 degrees or less. The difference is more preferably 30 degrees or 15 degrees or less.

In a case where an angle formed between the central axis and the front surface of the metal pattern layer is 90 degrees, a unit structure group giving an identical phase delay to transmitted electromagnetic waves is circularly disposed centering on the representative point. Plural types of unit structure groups giving different phase delays to transmitted electromagnetic waves are concentrically arranged centering on the representative point.

For example, as illustrated in FIG. 22 or 23, a reference point (for example, the center) is defined for each of plural arranged unit structures 20, and a distance N between the reference point and a representative point C is computed with respect to each unit structure 20. Plural unit structures 20 are grouped according to a value of N. For example, the unit structures 20 satisfying each of plural numerical value conditions such as $n0 \leq N \leq n1$, $n1 \leq N \leq n2$, $n2 \leq N \leq n3$, . . . may be included in an identical group. Configurations and characteristics of plural unit structures 20 in an identical group are assumed to be same as each other. Consequently, the circular and concentric arrangements can be realized.

Note that characteristics of unit structures of each group may be determined such that phase delay amounts of transmitted radio waves are increased with respect to incident radio waves according to an increase of a value of N such as $n0 \leq N \leq n1$, $n1 \leq N \leq n2$, $n2 \leq N \leq n3$, . . . . In this case, a phase delay amount starts from a second reference value, and the phase delay amount is increased by a predetermined amount according to an increase of a value of N.

However, in a case where an angle formed between the central axis and the front surface of the metal pattern layer is different from 90 degrees, a unit structure group deviating phases of transmitted electromagnetic waves by an identical amount surrounds the periphery of the representative point, for example, in such a shape in which a circle centering on the representative point is stretched toward one side, and an opposite side thereof is pressed with the circle center interposed therebetween. Plural types of unit structure groups deviating phases of transmitted electromagnetic waves by different amounts surround the periphery of the representative point in an identical shape and with different diameters. A surrounding shape in this case is defined according to, for example, a direction in which the central axis is tilted with respect to the metal pattern layer or an angle formed therebetween.

According to the communication apparatus 1 of the present example embodiment described above, it is possible to achieve the same advantageous effect as in the first example embodiment. According to the communication apparatus 1 of the present example embodiment, in a case where the radio wave radiation source 10D already has the low directivity feature, advancing directions of electromagnetic waves radiated from the radio wave radiation source 10D can be caused to spread in the width direction by using the second phase control plate 12 such that a lower directivity can be realized. Thus, a width of electromagnetic waves radiated from the radio wave radiation source 10 can be increased to a sufficient size at a shorter distance than in a case of not using the second phase control plate 12. As a result, a distance between the radio wave radiation source 10D and the first phase control plate 11 is reduced, and thus thinning of the communication apparatus 1 is realized.

Note that at least one of the first phase control plate 11 and the second phase control plate 12 of the present example embodiment may be implemented by a dielectric lens.

Specific Examples

Figure 30C:
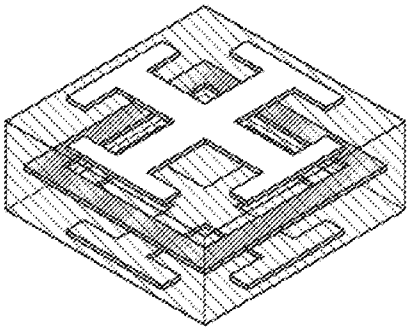
FIG. 30C is a diagram for explaining an example of a unit structure.
Figure 30B:
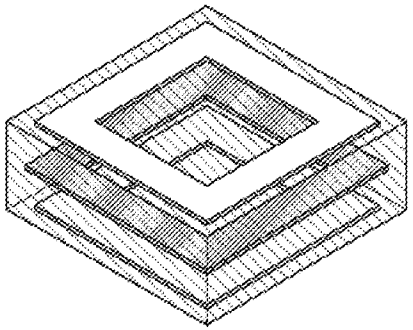
FIG. 30B is a diagram for explaining an example of a unit structure.
Figure 30A:
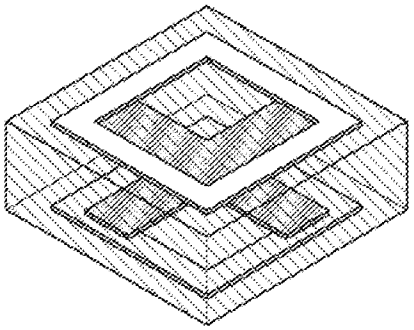
FIG. 30A is a diagram for explaining an example of a unit structure.

Here, FIGS. 30A-30C illustrate a modification of a unit structure configured with metal patterns of three layers on the basis of a series resonance type and an inductance type. In FIGS. 30A-30C, serial numbers of 1 to 3 are given to respective unit structures. The present inventor has found that desired phase control is realized by adjusting the metal patterns of three layers in this example. In FIG. 30A, a quadrangular annular metal pattern, a cross-shaped metal pattern, and a quadrangular annular metal pattern are laminated in this order. In FIG. 30B, three quadrangular annular metal patterns are laminated. In FIG. 30C, a cross-shaped metal pattern of which a line width of each end is large, a quadrangular annular metal pattern, and a cross-shaped metal pattern of which a line width of each end is large are laminated in this order.

Figure 31:
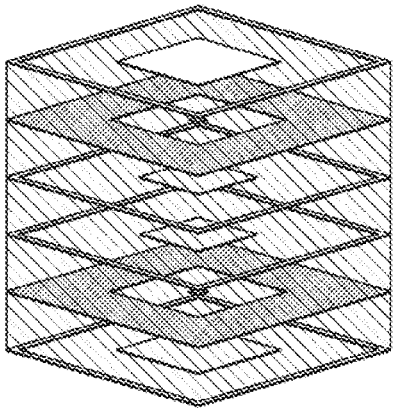
FIG. 31 is a diagram for explaining an example of a unit structure.

Next, FIG. 31 illustrates an example of a unit structure configured with metal patterns of six layers on the basis of a parallel resonance type. In the illustrated unit structure, six metal patterns each including a quadrangular internal metal and a quadrangular annular metal surrounding the outer periphery of the internal metal are laminated. Although just one example is described herein, the present inventor has found that phase control can be realized in the entire phase range (for example, from −180 degrees to 180 degrees) by adjusting the metal patterns of six layers of the unit structure.

Figure 32:
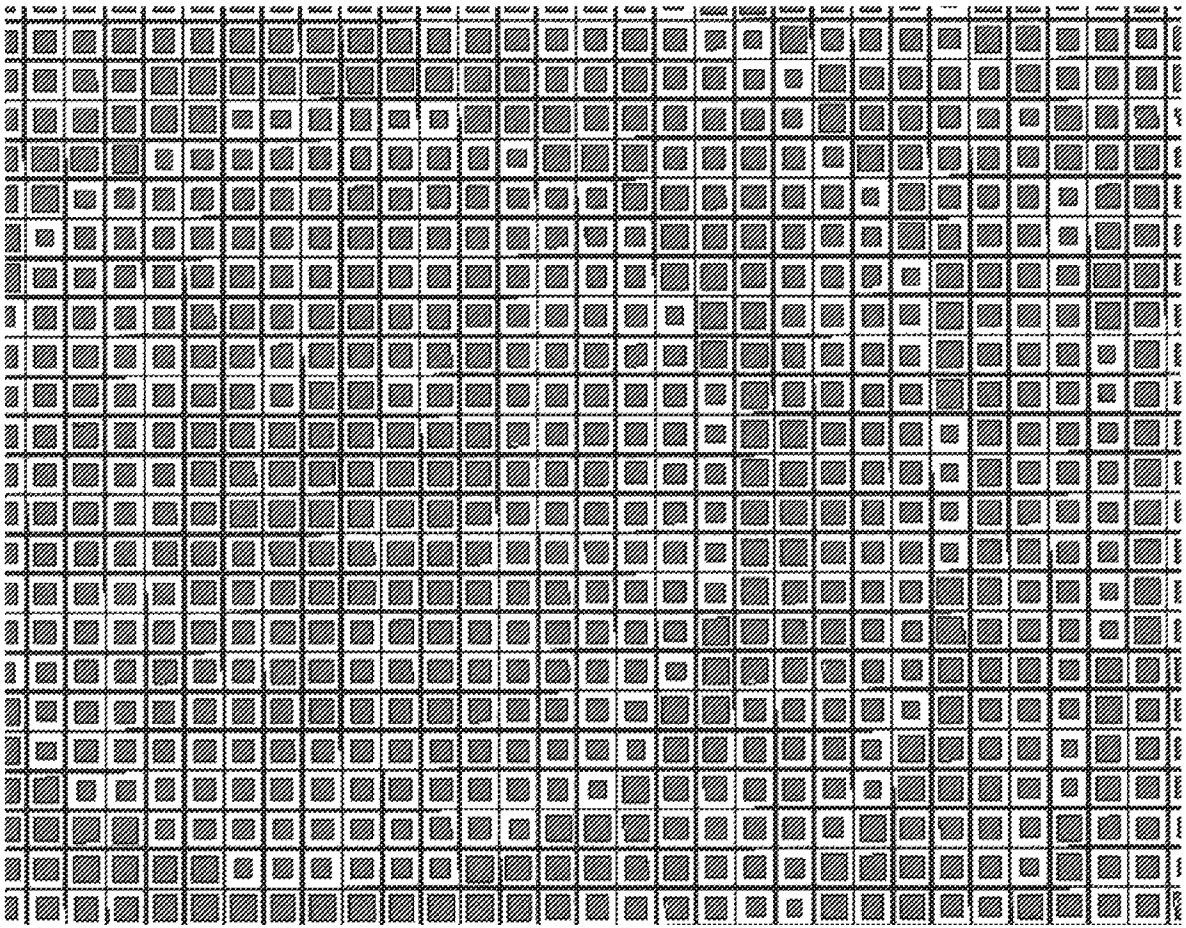
FIG. 32 is a diagram for explaining an example of a metal pattern.

FIG. 32 illustrates a part of an example of a metal pattern of one certain layer in a phase control plate configured by arranging modifications of a unit structure giving different phase delays, which is realized by adjusting the unit structure illustrated in FIG. 31 and the metal patterns of the unit structure illustrated in FIG. 31. Quadrangular metals are arranged. Therein, plural types of metals having different areas are mixed with each other. The present inventor has checked that the advantageous effect described in the example embodiments can be achieved in the phase control plate having plural metal pattern layers through simulation.

Hereinafter, examples of reference embodiments are added.

1. A communication apparatus including:

a radiation source that radiates an electromagnetic wave; and a first phase control plate that is disposed at a position of a distance $L_1$ in a radio wave radiation direction from the radiation source, in which, in the first phase control plate, a phase of a transmitted electromagnetic wave differs according to a distance from a representative point on the first phase control plate, and in which the radiation source is able to supply power up to a position separated from the representative point on the first phase control plate by $L_1/2$.

2. The communication apparatus according to 1, in which the first phase control plate reduces a phase delay amount between an incidence surface and an emission surface from the representative point toward an edge of the first phase control plate.

3. The communication apparatus according to 1 or 2, in which the radiation source includes a slot opening that has a rectangular shape which is open in a disposition direction of the first phase control plate, and a conductive plate that connects a long side of the slot opening to a surface of the first phase control plate.

4. The communication apparatus according to 3, further including:

a conductive plate that connects a short side of the slot opening having a rectangular shape to the surface of the first phase control plate.

5. The communication apparatus according to 1 or 2, in which the radiation source includes a slot opening that has a rectangular shape which is open in a disposition direction of the first phase control plate, and in which a length of a diameter of a conductive plate in which the slot opening is formed, orthogonal to a long side of the slot opening, is ten times or less the length of the long side of the slot opening.

6. The communication apparatus according to any one of 1 to 5, further including:

a second phase control plate that is located between the radiation source and the first phase control plate, in which, in the second phase control plate, a phase of a transmitted electromagnetic wave differs according to a distance from a representative point on the second phase control plate.

7. The communication apparatus according to 6, in which the first phase control plate reduces a phase delay amount between an incidence surface and an emission surface from the representative point on the first phase control plate toward an edge of the first phase control plate, and in which the second phase control plate increases a phase delay amount between an incidence surface and an emission surface from the representative point on the second phase control plate toward an edge of the second phase control plate.

8. The communication apparatus according to any one of 1 to 7, in which the first phase control plate or the second phase control plate is configured by two-dimensionally arranging plural types of unit structures configured to include metals, and in which a unit structure group deviating phases of transmitted electromagnetic waves by an identical amount surrounds the periphery of the representative point.

9. The communication apparatus according to 8, in which each of plural types unit structure groups deviating phases of transmitted electromagnetic waves by different amounts surrounds the representative point.

10. The communication apparatus according to 8 or 9, in which a difference in a phase amount deviated between unit structures of the unit structure group deviating phases of transmitted electromagnetic waves by an identical amount is degrees or less.

11. The communication apparatus according to any one of 1 to 10, in which each of the first phase control plate and the second phase control plate is configured with plural metal pattern layers.

12. The communication apparatus according to 11, in which the metal pattern layers are meta-surfaces.

13. The communication apparatus according to any one of 1 to 7, in which the first phase control plate or the second phase control plate is a dielectric lens.

14. The communication apparatus according to any one of 1 to 13, in which the first phase control plate is located in a direction in which the radiation source radiates an electromagnetic wave, and extends in a direction substantially perpendicular to the direction.

15. The communication apparatus according to any one of 1 to 12 and 14, in which the first phase control plate has a split ring structure.

16. The communication apparatus according to any one of 1 to 15, in which a distance between the radiation source and the first phase control plate is shorter than a diameter of the first phase control plate.

This application is based upon and claims the benefit of priority from Japanese Patent Application No. 2016-219178, filed Nov. 9, 2016; the entire contents of which are incorporated herein by reference.

What is claimed is:

1. A communication apparatus comprising:

a radiation source that radiates an electromagnetic wave; and a first phase control plate that is disposed at a position of a distance $L_1$ in a radio wave radiation direction from the radiation source, wherein, in the first phase control plate, a phase of a transmitted electromagnetic wave differs according to a distance from a representative point on the first phase control plate, and wherein the radiation source is able to supply power up to a position separated from the representative point on the first phase control plate by $L_1/2$.

2. The communication apparatus according to claim 1, wherein the first phase control plate reduces a phase delay amount between an incidence surface and an emission surface from the representative point toward an edge of the first phase control plate.

3. The communication apparatus according to claim 1, wherein the radiation source comprises a slot opening that has a rectangular shape which is open in a disposition direction of the first phase control plate, and a conductive plate that connects a long side of the slot opening to a surface of the first phase control plate.

4. The communication apparatus according to claim 3, further comprising:

a conductive plate that connects a short side of the slot opening having a rectangular shape to the surface of the first phase control plate.

5. The communication apparatus according to claim 1, wherein the radiation source includes a slot opening that has a rectangular shape which is open in a disposition direction of the first phase control plate, and wherein a length of a diameter of a conductive plate in which the slot opening is formed, orthogonal to a long side of the slot opening, is ten times or less the length of the long side of the slot opening.

6. The communication apparatus according to claim 1, further comprising:

a second phase control plate that is located between the radiation source and the first phase control plate, wherein, in the second phase control plate, a phase of a transmitted electromagnetic wave differs according to a distance from a representative point on the second phase control plate.

7. The communication apparatus according to claim 6, wherein the first phase control plate reduces a phase delay amount between an incidence surface and an emission surface from the representative point on the first phase control plate toward an edge of the first phase control plate, and wherein the second phase control plate increases a phase delay amount between an incidence surface and an emission surface from the representative point on the second phase control plate toward an edge of the second phase control plate.

8. The communication apparatus according to claim 6, wherein the first phase control plate or the second phase control plate is configured by two-dimensionally arranging a plurality of types of unit structures configured to include metals, and wherein a unit structure group deviating phases of transmitted electromagnetic waves by an identical amount surrounds the periphery of the representative point.

9. The communication apparatus according to claim 8, wherein each of a plurality of types unit structure groups deviating phases of transmitted electromagnetic waves by different amounts surrounds the representative point.

10. The communication apparatus according to claim 8, wherein a difference in a phase amount deviated between unit structures of the unit structure group deviating phases of transmitted electromagnetic waves by an identical amount is 45 degrees or less.

11. The communication apparatus according to claim 6, wherein each of the first phase control plate and the second phase control plate is configured with a plurality of metal pattern layers.

12. The communication apparatus according to claim 11, wherein the metal pattern layers are meta-surfaces.

13. The communication apparatus according to claim 6, wherein the first phase control plate or the second phase control plate is a dielectric lens.

14. The communication apparatus according to claim 1, wherein the first phase control plate is located in a direction in which the radiation source radiates an electromagnetic wave, and extends in a direction substantially perpendicular to the direction.

15. The communication apparatus according to claim 1, wherein the first phase control plate has a split ring structure.

16. The communication apparatus according to claim 1, wherein a distance between the radiation source and the first phase control plate is shorter than a diameter of the first phase control plate.

* * * * *